US009687400B2

(12) United States Patent
Bly et al.

(10) Patent No.: US 9,687,400 B2
(45) Date of Patent: Jun. 27, 2017

(54) ADJUSTABLE BED

(71) Applicant: Invacare Corporation, Elyria, OH (US)

(72) Inventors: Robert R. Bly, Wellington, OH (US); Kevin S. Wysocki, Grafton, OH (US)

(73) Assignee: Invacare Corp., Elyria, OH (US)

( * ) Notice: Subject to any disclaimer, the term of this patent is extended or adjusted under 35 U.S.C. 154(b) by 384 days.

(21) Appl. No.: 14/354,319

(22) PCT Filed: Oct. 2, 2012

(86) PCT No.: PCT/US2012/058414
§ 371 (c)(1),
(2) Date: Apr. 25, 2014

(87) PCT Pub. No.: WO2013/052452
PCT Pub. Date: Apr. 11, 2013

(65) Prior Publication Data

US 2014/0325759 A1 Nov. 6, 2014

Related U.S. Application Data

(60) Provisional application No. 61/542,255, filed on Oct. 2, 2011, provisional application No. 61/640,180, filed on Apr. 30, 2012.

(51) Int. Cl.
*A61G 7/015* (2006.01)
*A47C 20/04* (2006.01)
(Continued)

(52) U.S. Cl.
CPC ..... *A61G 7/015* (2013.01); *A47C 19/005* (2013.01); *A61G 7/002* (2013.01); *A61G 7/012* (2013.01); *A61G 7/018* (2013.01); *A47C 20/041* (2013.01)

(58) Field of Classification Search
CPC ..... A61G 7/002; A61G 7/015; A61G 7/018; A61G 7/012; A47C 19/005; A47C 20/04; A47C 20/041; A47C 20/08; A47C 20/12
See application file for complete search history.

(56) References Cited

U.S. PATENT DOCUMENTS 2,337,284 A * 12/1943 Urie ..... A61G 7/015 5/618
4,120,057 A * 10/1978 Neumann ..... A47C 20/041 5/616

(Continued)

FOREIGN PATENT DOCUMENTS

EP 1535593 A1 8/2003
EP 2361595 A2 8/2011

(Continued)

OTHER PUBLICATIONS

Extended European Search Report for EP Application No. 12838049.0.

(Continued)

*Primary Examiner* — Nicholas Polito
(74) *Attorney, Agent, or Firm* — Calfee, Halter & Griswold LLP

(57) ABSTRACT

An exemplary bed platform frame includes first and second support frame assemblies, each including a pair of spaced apart rails, a cross member extending between the pair of spaced apart rails, and an actuator support member coupled to the cross member. The spaced apart rails of the first support frame assembly are connected to the spaced apart rails of the second support frame assembly when the first support frame assembly is assembled with the second support frame assembly. The actuator support member of the first support frame assembly is coupled to the cross member of the second support frame assembly when the first support frame assembly is assembled with the second support frame (Continued)

assembly. The actuator support member of the second support frame assembly is coupled to the cross member of the first support frame assembly when the first support frame assembly is assembled with the second support frame assembly.

22 Claims, 29 Drawing Sheets

(51) Int. Cl.

| | |
|---|---|
| ***A47C 19/00*** | (2006.01) |
| ***A61G 7/002*** | (2006.01) |
| ***A61G 7/012*** | (2006.01) |
| ***A61G 7/018*** | (2006.01) |

(56) References Cited

U.S. PATENT DOCUMENTS

| | | | | |
|---|---|---|---|---|
| 4,381,571 | A * | 5/1983 | Elliott | A61G 7/015 5/616 |
| 4,970,737 | A * | 11/1990 | Sagel | A47C 20/08 5/201 |
| 5,165,129 | A * | 11/1992 | Rohm | A61G 7/015 5/613 |
| 5,568,661 | A * | 10/1996 | Bathrick | A47C 20/041 5/285 |
| 5,926,877 | A | 7/1999 | Lin | |
| 6,343,392 | B1 * | 2/2002 | Becker | A47C 20/041 5/616 |
| 6,679,555 | B2 * | 1/2004 | Bangert | A47C 20/08 297/316 |
| 2005/0166323 | A1 | 8/2005 | Kawakami et al. | |
| 2006/0162079 | A1 | 7/2006 | Menkedick et al. | |
| 2006/0168728 | A1 | 8/2006 | Strobel et al. | |
| 2008/0000028 | A1 | 1/2008 | Lemire et al. | |
| 2011/0197361 | A1 * | 8/2011 | Hornbach | A61G 7/012 5/618 |

FOREIGN PATENT DOCUMENTS

| | | | |
|---|---|---|---|
| WO | 2004021952 | A2 | 3/2004 |
| WO | 2004060257 | A2 | 7/2004 |

OTHER PUBLICATIONS

International Search Report dated Jan. 2, 2013, for International Application Serial No. PCT/US2012/058414.

Written Opinion dated Jan. 2, 2013, for International Application Serial No. PCT/US2012/058414.

International Preliminary Report on Patentability dated Apr. 8, 2014, for International Application Serial No. PCT/US2012/058414.

* cited by examiner

ADJUSTABLE BED

CROSS REFERENCE TO RELATED APPLICATIONS

The present application is a national phase entry under 35 U.S.C. §371 of, and claims priority to, International Application No. PCT/US2012/058414 filed on Oct. 2, 2012, for ADJUSTABLE BED, which claims priority to U.S. Provisional Patent Application Ser. No. 61/542,255 filed on Oct. 2, 2011, and U.S. Provisional Patent Application Ser. No. 61/640,180 filed on Apr. 30, 2012, the entire disclosures of which are fully incorporated herein by reference.

BACKGROUND

Patients residing in long-term care facilities such as nursing homes and rehabilitation facilities usually require beds that include moveable head end and foot end sections of the sleep surface. The head end section has an adjustable portion that can be raised up when the bed is assembled, to raise the patient's head. The foot end section has an adjustable portion that can be raised up when the bed is assembled, to raise the patient's knees. The sleep surface and related components are attached to a frame which provides a rigid supporting structure. Also attached to the frame are the components for elevating or tilting the bed frame relative to the support surface. These beds typically utilize multiple manual crank devices or electric actuators to provide separate elevating movement of the head end and foot end sections of the sleep surface and also to raise, lower or tilt the entire frame and sleep surface relative to the support surface.

SUMMARY

In an exemplary embodiment, the present application describes an exemplary bed platform frame including first and second support frame assemblies, each including a pair of spaced apart rails, a cross member extending between the pair of spaced apart rails, and an actuator support member coupled to the cross member. The spaced apart rails of the first support frame assembly are connected to the spaced apart rails of the second support frame assembly when the first support frame assembly is assembled with the second support frame assembly. The actuator support member of the first support frame assembly is coupled to the cross member of the second support frame assembly when the first support frame assembly is assembled with the second support frame assembly. The actuator support member of the second support frame assembly is coupled to the cross member of the first support frame assembly when the first support frame assembly is assembled with the second support frame assembly.

The present application also describes exemplary embodiments of beds and bed platform frames including a first actuator for moving a first moveable mattress support between a substantially flat position and an elevated position, and a second actuator for moving a second moveable mattress support between a substantially flat position and an elevated position. In one such exemplary embodiment, the first and second actuators are electrically powered actuators. In another exemplary embodiment, the first actuator is an electrically powered actuator and the second actuator is a manually operated mechanical linking actuator. In still another exemplary embodiment, a bed or bed platform frame is configurable for independent actuation of first and second mattress supports when a powered actuator is coupled to the second movable mattress support, and configurable for linked actuation of the first and second mattress supports when a linking actuator is coupled to the first movable mattress support and to the second movable mattress support.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to provide examples of the principles of this invention.

DETAILED DESCRIPTION

This Detailed Description merely describes embodiments of the invention and is not intended to limit the scope of the claims in any way. Indeed, the invention as claimed is broader than and unlimited by the preferred embodiments, and the terms used in the claims have their full ordinary meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

Figure 1A:
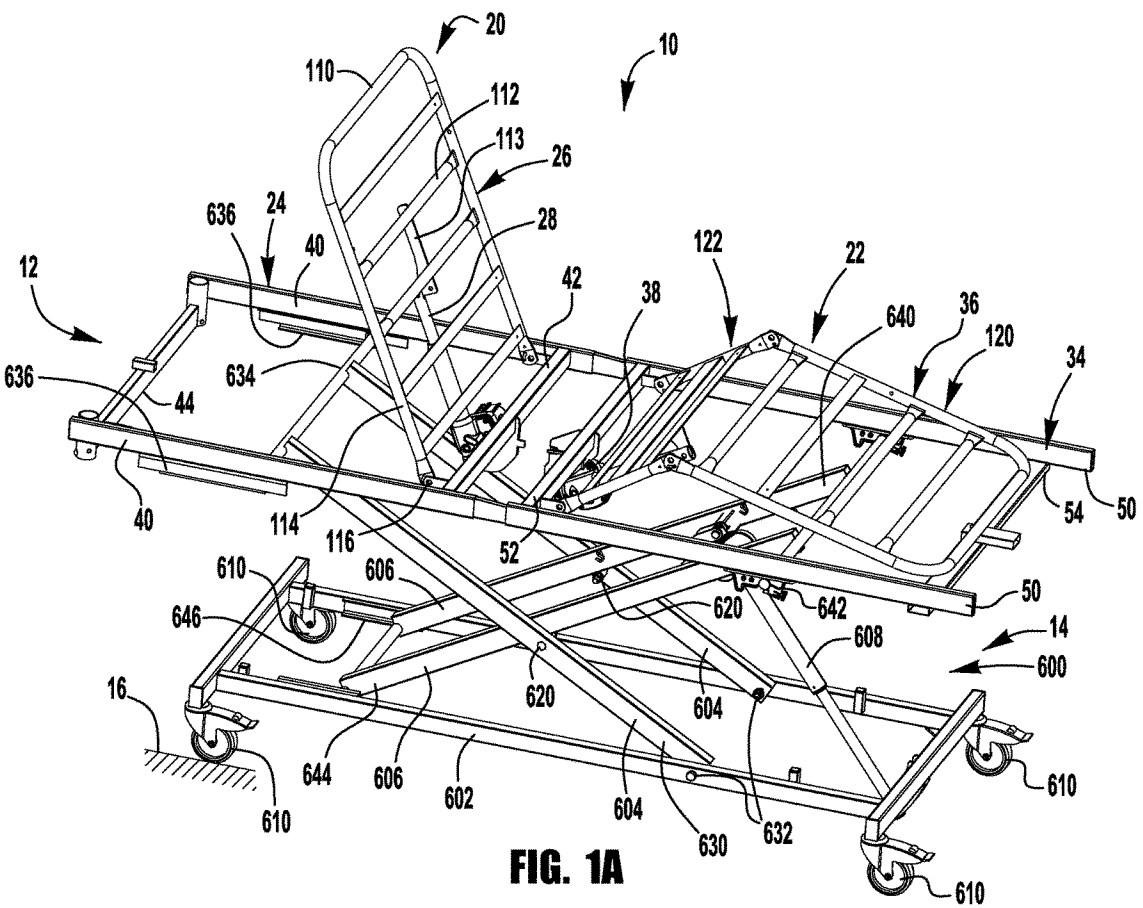
FIG. 1A is a perspective view of an exemplary embodiment of a bed where rails of a frame of the bed are disconnected.

FIG. 1A illustrates an exemplary embodiment of a bed 10. The bed 10 can take a wide variety of different forms. The illustrated bed 10 includes a bed platform 12 and a base 14 that supports the bed platform above a support surface 16, such as a floor. The base 14 is optionally configured to raise and lower the bed platform 12 with respect to the support surface 16.

The bed platform 12 can take a wide variety of different forms. In the illustrated embodiment, the bed platform 12 includes first and second platform sections that are assembled together, such as a head end platform section 20, and a foot end platform section 22. The head end platform section 20 and the foot end platform section 22 can take a wide variety of different forms. In the illustrated embodiment, the head end platform section 20 includes a head end support frame assembly 24, a head end moveable mattress support 26, and a head end actuator 28. The illustrated foot end platform section 22 includes a foot end support frame assembly 34, a foot end moveable mattress support 36, and a foot end actuator 38 (see FIG. 1C).

The head end and foot end support frame assemblies 24, 34 can take a wide variety of different forms. In the illustrated exemplary embodiment, the head end support frame assembly 24 includes a pair of spaced apart rails 40, first and second cross members 42, 44 extending between the pair of spaced apart rails 40, and an actuator support member 46 (see FIG. 1C) coupled to the cross member 42. The spaced apart rails 40 are connected by the cross members 42, 44. In the illustrated embodiment, the actuator support member 46 is fixedly connected to the cross member 42. The illustrated foot end support frame assembly 34 comprising a pair of spaced apart rails 50, first and second cross members 52, 54 extending between the pair of spaced apart rails 50, and an actuator support member 56 (see FIG. 1C) coupled to the cross member. The spaced apart rails 50 are connected by the cross members 52, 54. In the illustrated embodiment, the actuator support member 56 is fixedly connected to the cross member 52.

The spaced apart rails 40 of the head end support frame assembly 24 are connected to the spaced apart rails 50 of the foot end support frame assembly 34 when the head end platform section 20 is assembled with the foot end platform section 22. The rails 40 of the head end support frame assembly 24 can be connected to the rails 50 of the foot end support frame assembly 34 in a wide variety of different ways. For example, the rails 40, 50 can be assembled with any type of fastening or connecting arrangement or the rails 40, 50 can telescopically engage one another. For example, referring to FIG. 2, at least one of the rails 50 may include a portion 51 that extends into an opening 41 of at least one of the rails 40 when the head end platform section 20 is assembled with the foot end platform section 22. Ends 43 of the rails 40 may abut ends 53 of the rails 50 to set the relative positions of the rails 40, 50. Any connecting arrangement may be used. The illustrated rails 40, 50 are rectangular tubes. However, the rails 40, 50 may have any configuration. For example, the rails 40, 50 may be tubular, with any cross section, channel shaped, etc. and the rails 40 may have the same configuration as the rails 50 or a different configuration than the rails 50.

In the illustrated embodiment, the actuator support member 46 of the head end support frame assembly 24 is coupled to the cross member 52 of the foot end support frame assembly 34 when the head end platform section 20 is assembled with the foot end platform section 22. In another embodiment, the actuator support member 46 of the head end support frame assembly 24 is coupled to a member other than the cross member 52 of the foot end support frame assembly 34 when the head end platform section 20 is assembled with the foot end platform section 22. In another embodiment, the actuator support member 46 of the head end support frame assembly 24 is not coupled to any member of the foot end support frame assembly 34 when the head end platform section 20 is assembled with the foot end platform section 22.

Figure 3:
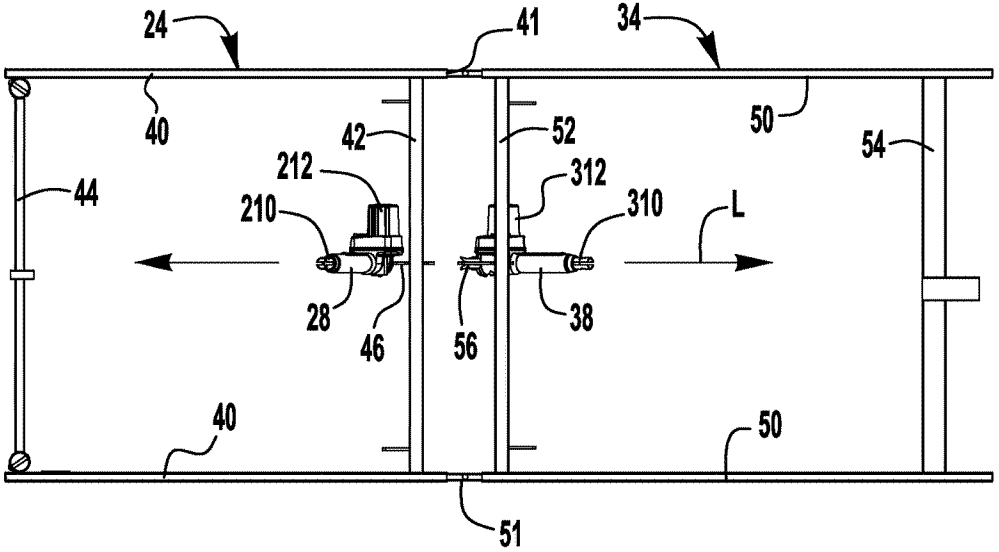
FIG. 3 is a top view of an exemplary embodiment of a support frame and actuators of a bed.

The actuator support member 46 of the head end support frame assembly 24 may be coupled to the cross member 52 of the foot end support frame assembly 34 in a wide variety of different ways. Examples of suitable coupling arrangements include, but are not limited to, fasteners, such as pins, nuts, bolts, etc., quick connect arrangements, and telescoping arrangements. The actuator support member 46 of the head end support frame assembly 24 may be directly coupled to the cross member 52 of the foot end support frame assembly 34 or indirectly coupled to the cross member 52 of the foot end support frame assembly 34 by one or more intermediate members. FIG. 3 illustrates an example where the actuator support members 46, 56 couple with one another and FIG. 4 illustrates an example where the actuator support members 46, 56 couple with separate intermediate members 48, 58 that are attached to the cross members 52, 42.

Figure 2:
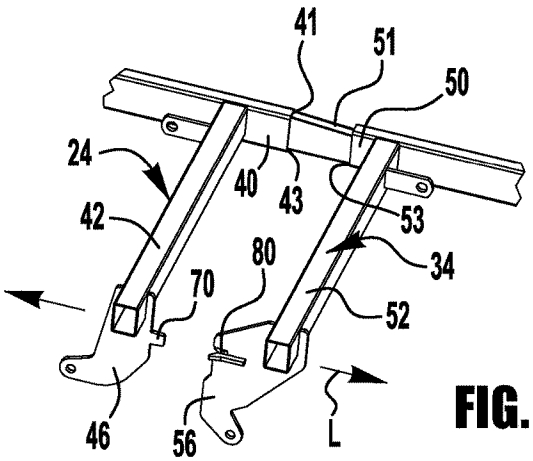
FIG. 2 is shows an enlarged portion of a support frame of the bed platform illustrated by FIG. 1C.

In the exemplary embodiment illustrated by FIG. 3, the actuator support member 46 of the head end support frame assembly 24 is coupled to the actuator support member 56 of the foot end support frame assembly 34 to couple the actuator support member of the head end support frame assembly 24 to the cross member 52 of the foot end support frame assembly 34. Referring to FIG. 2, the actuator support member 46 of the head end support frame assembly 24 telescopically engages the actuator support member 56 of the foot end support frame assembly 34 when the head end support frame assembly 24 is assembled with the foot end support frame assembly 34. In the illustrated embodiment, a portion 70 of the actuator support member 46 of the head end support frame assembly 24 extends into and optionally abuts a portion 80 of the actuator support member 56 of the foot end support frame assembly 34. In the example illustrated by FIG. 3, the actuator support member 46 of the head end support frame assembly 24 assembly is aligned in the longitudinal direction L of the frame with the actuator support member 56 of the foot end support frame assembly 34 when the head end support frame assembly 24 is assembled with the foot end support frame assembly 34.

Figure 4:
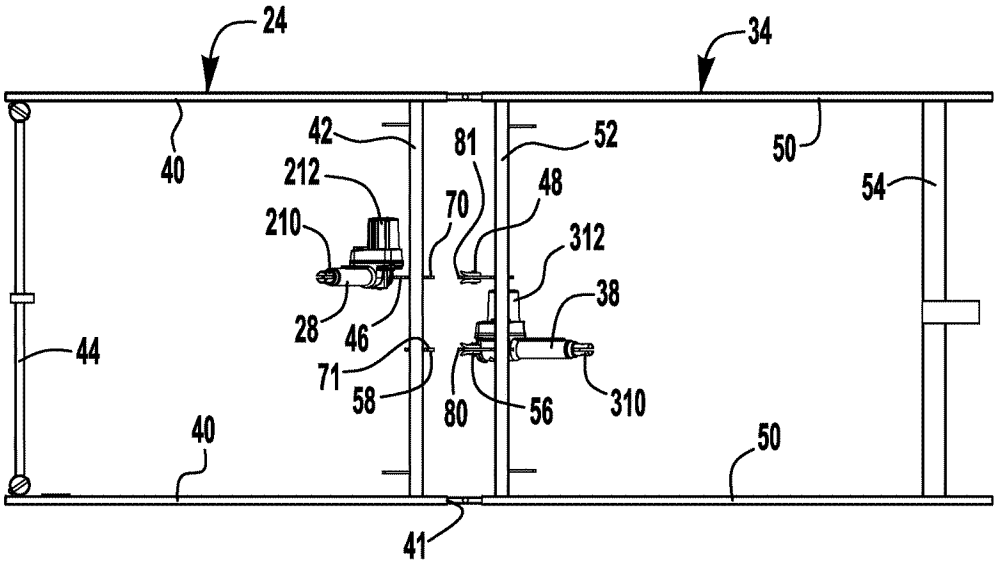
FIG. 4 is a top view of an exemplary embodiment of a support frame and actuators of a bed.
Figure 5A:
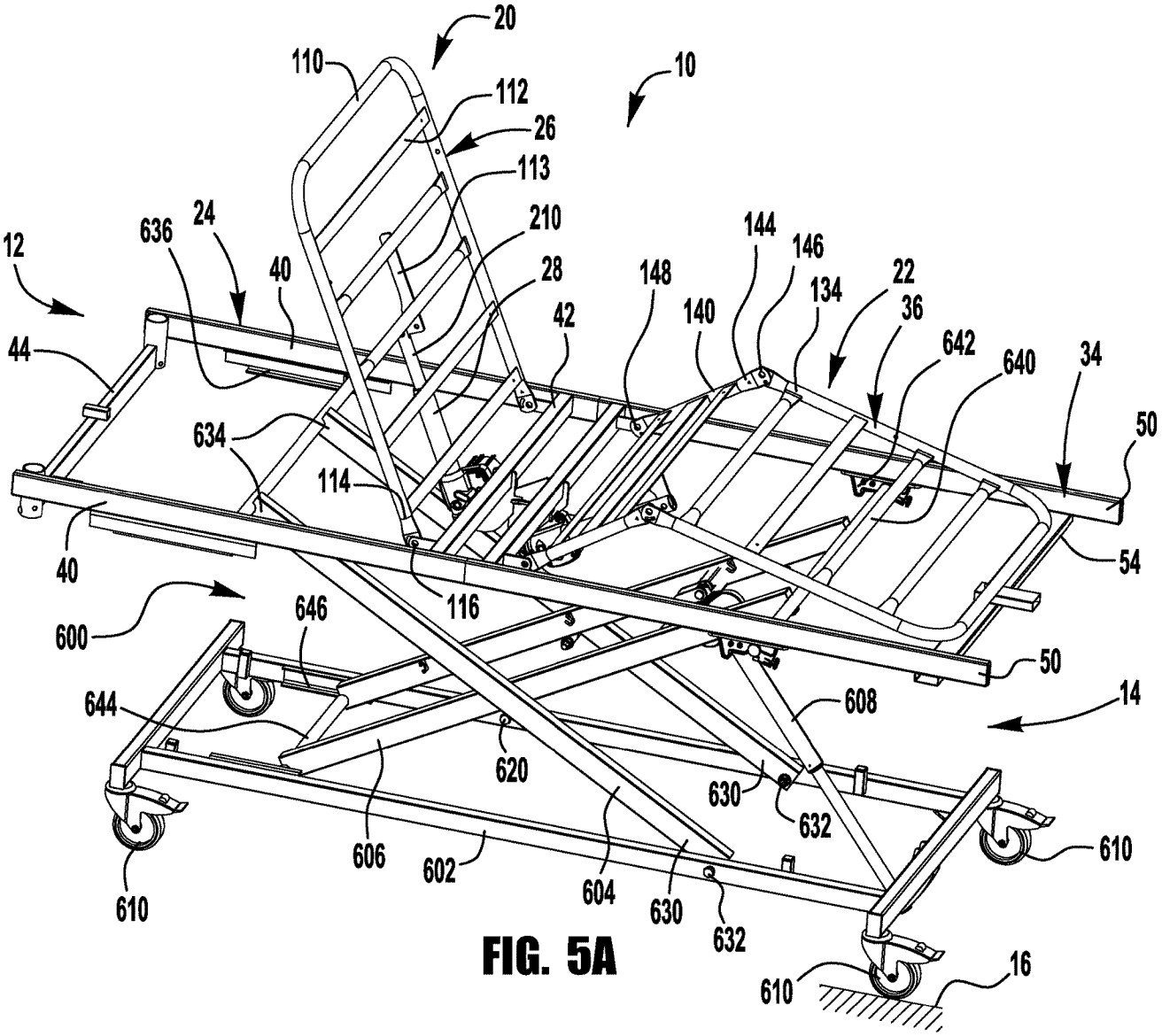
FIG. 5A is a view similar to the view of FIG. 1 where the rails of the frame of the bed have been connected.
Figure 5B:
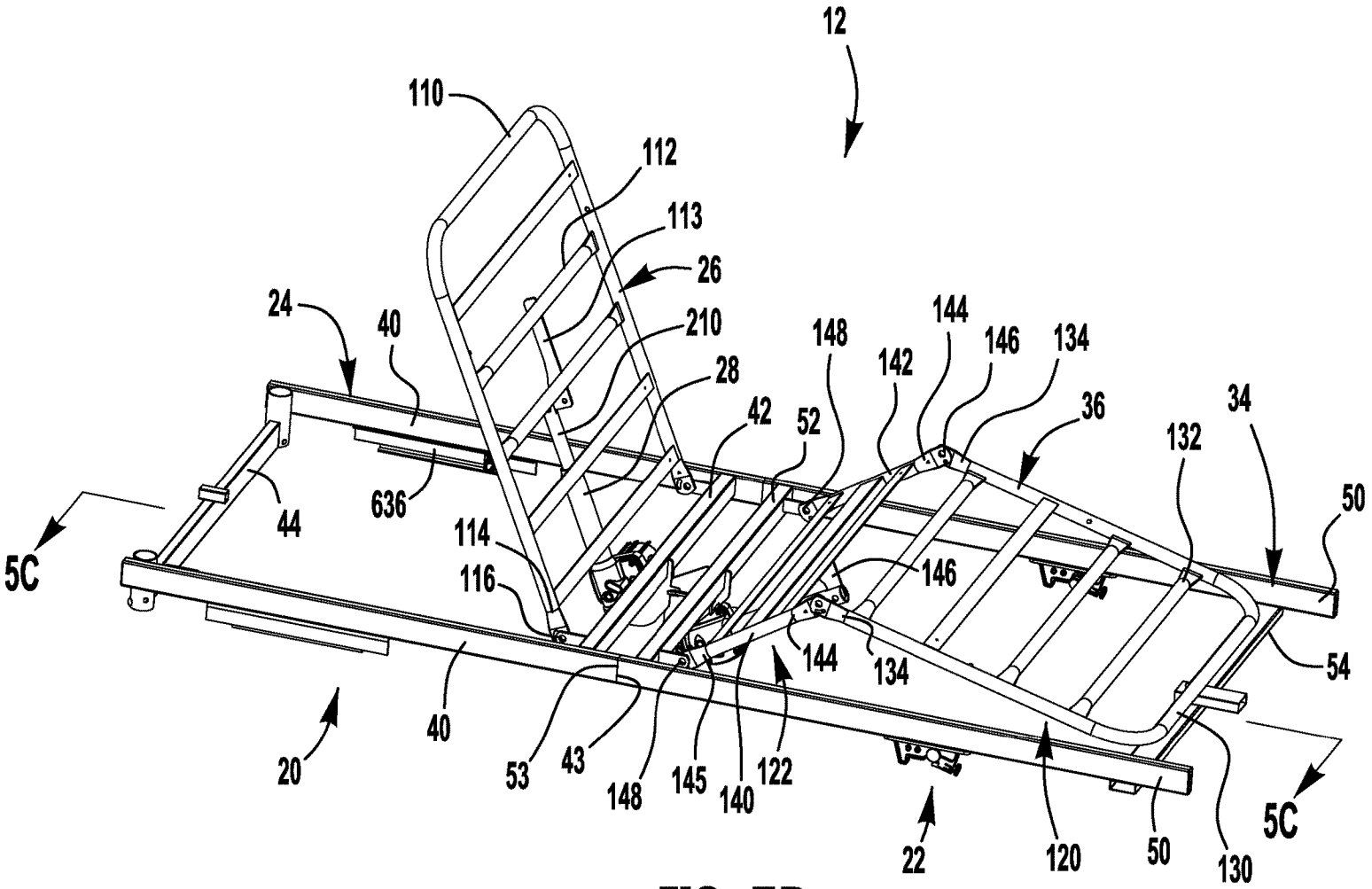
FIG. 5B is a perspective view of a bed platform of the bed illustrated by FIG. 5A.
Figure 5C:
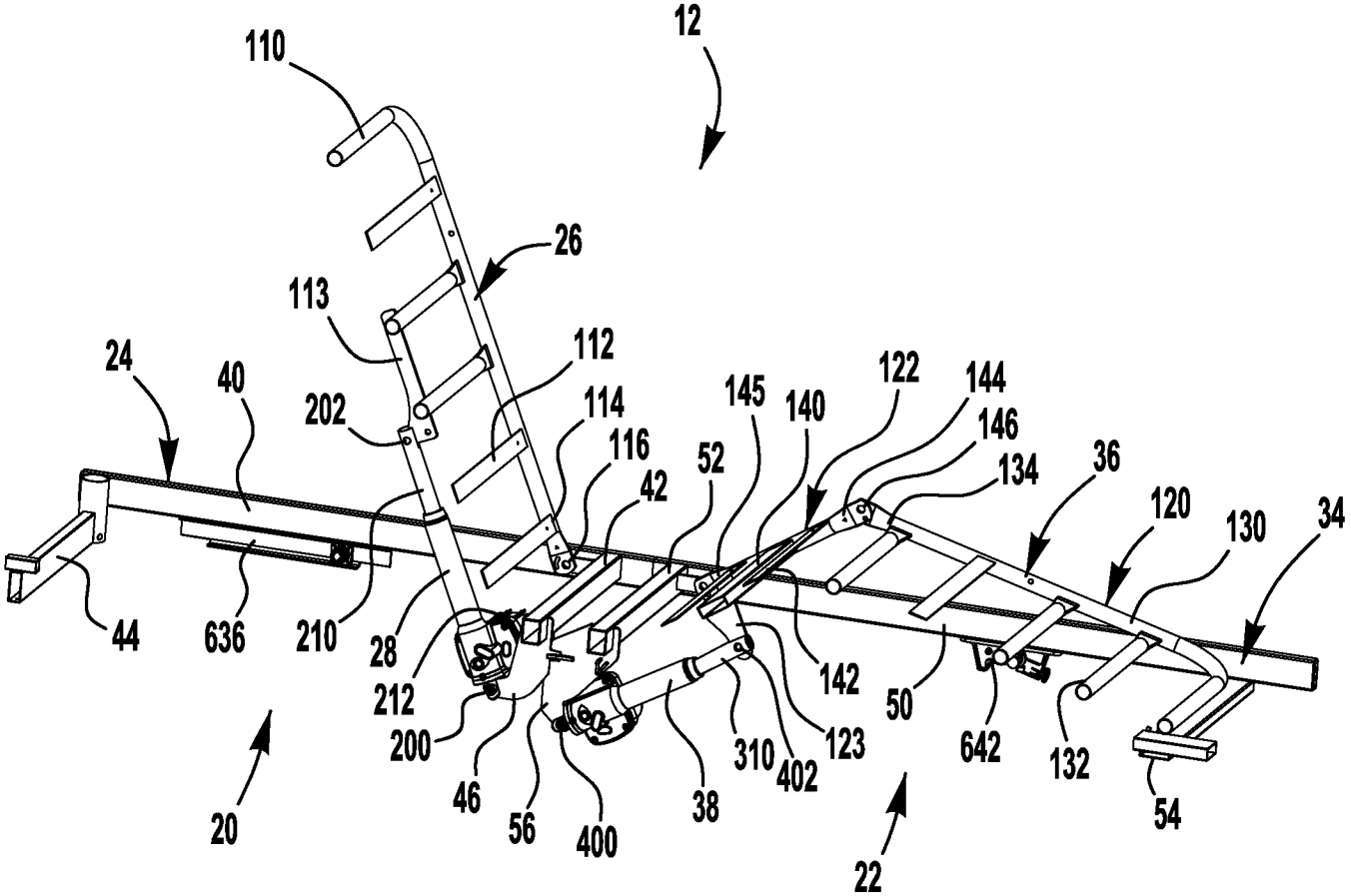
FIG. 5C is a sectioned perspective view with the section taken along the plane indicated by lines 5C-5C in FIG. 5B.
Figure 5D:
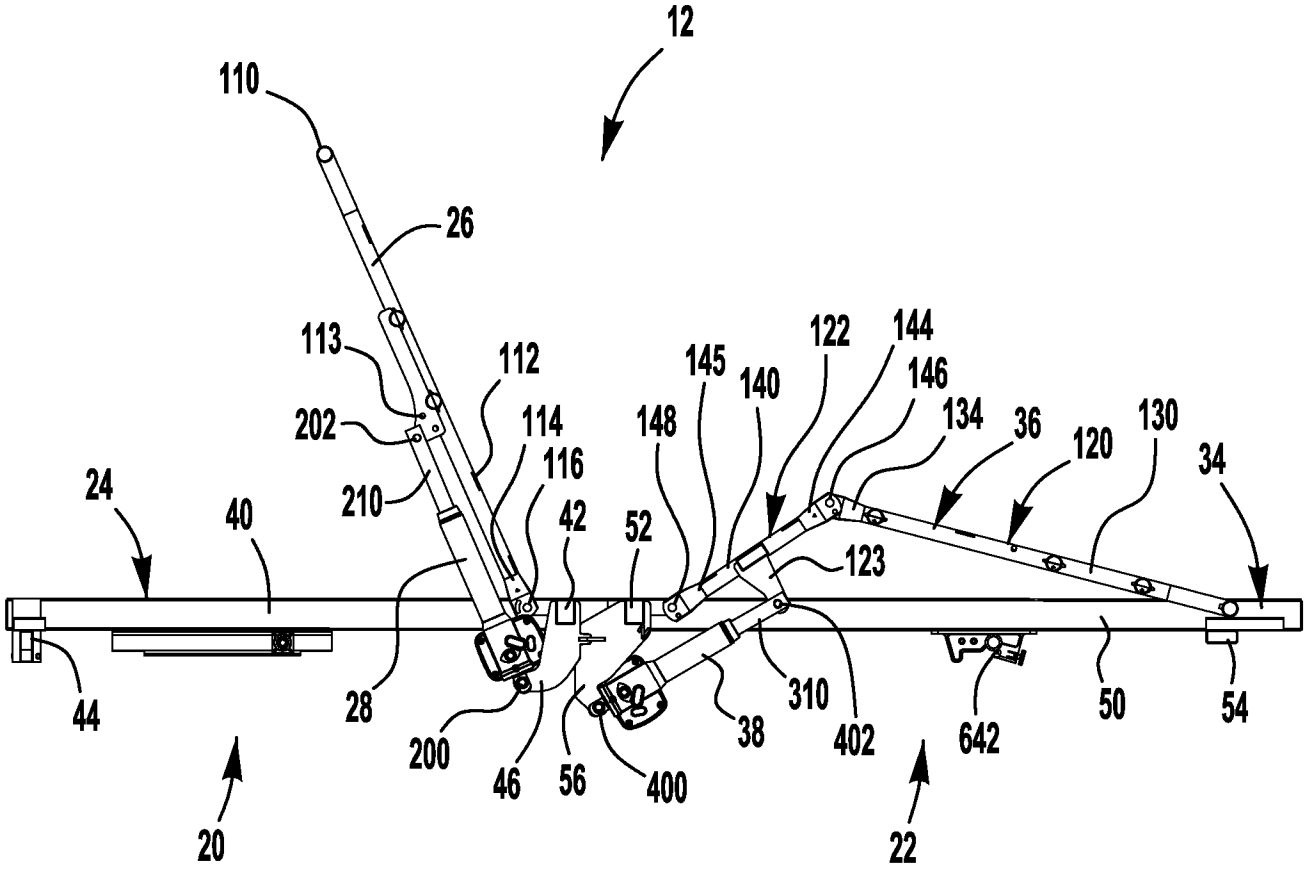
FIG. 5D is a sectional view with the section taken along the plane indicated by lines 5C-5C in FIG. 5B.
Figure 6A:
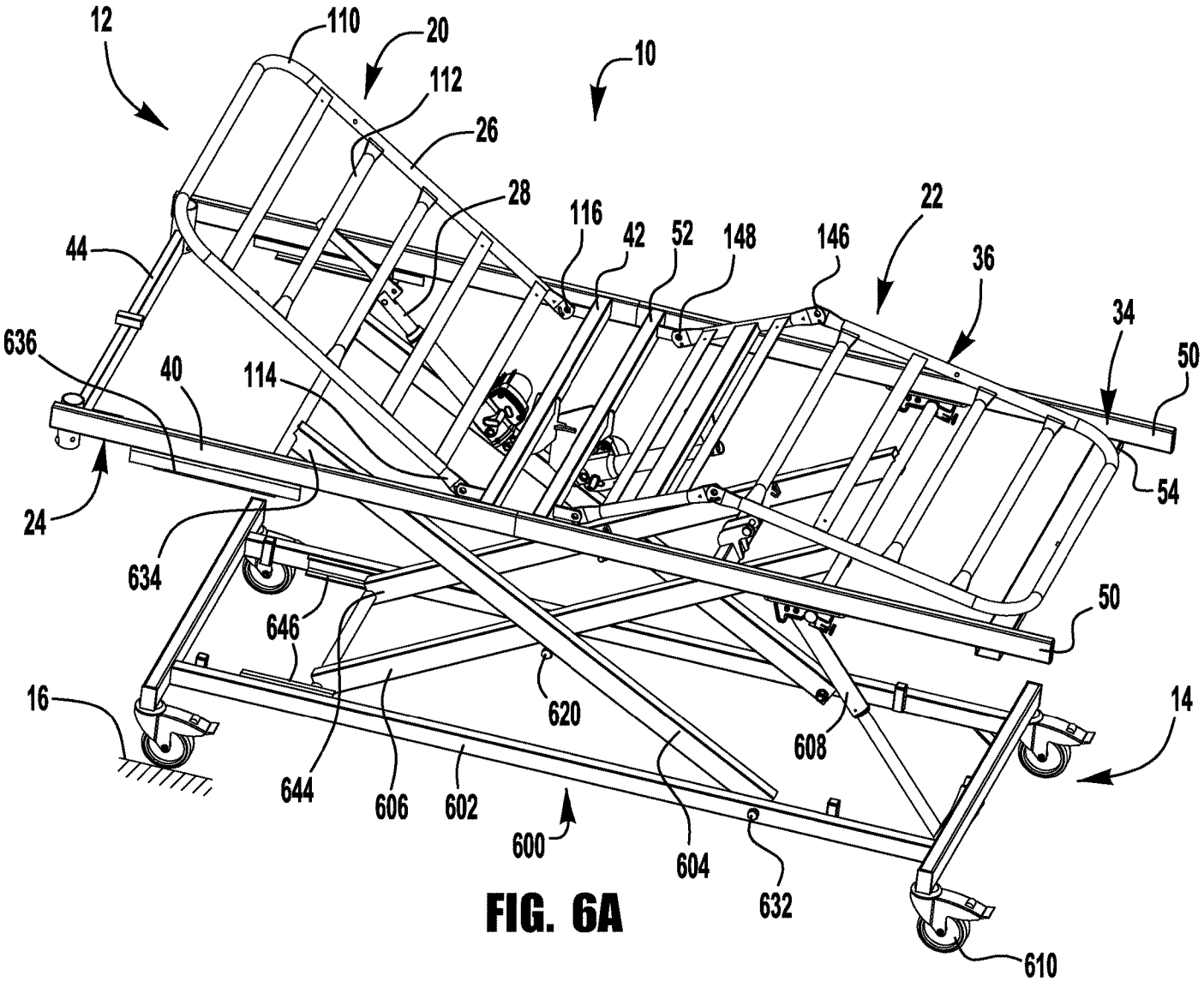
FIG. 6A is a view similar to the view of FIG. 5A where moveable mattress supports have been moved downward from the positions shown in FIG. 5A.
Figure 6B:
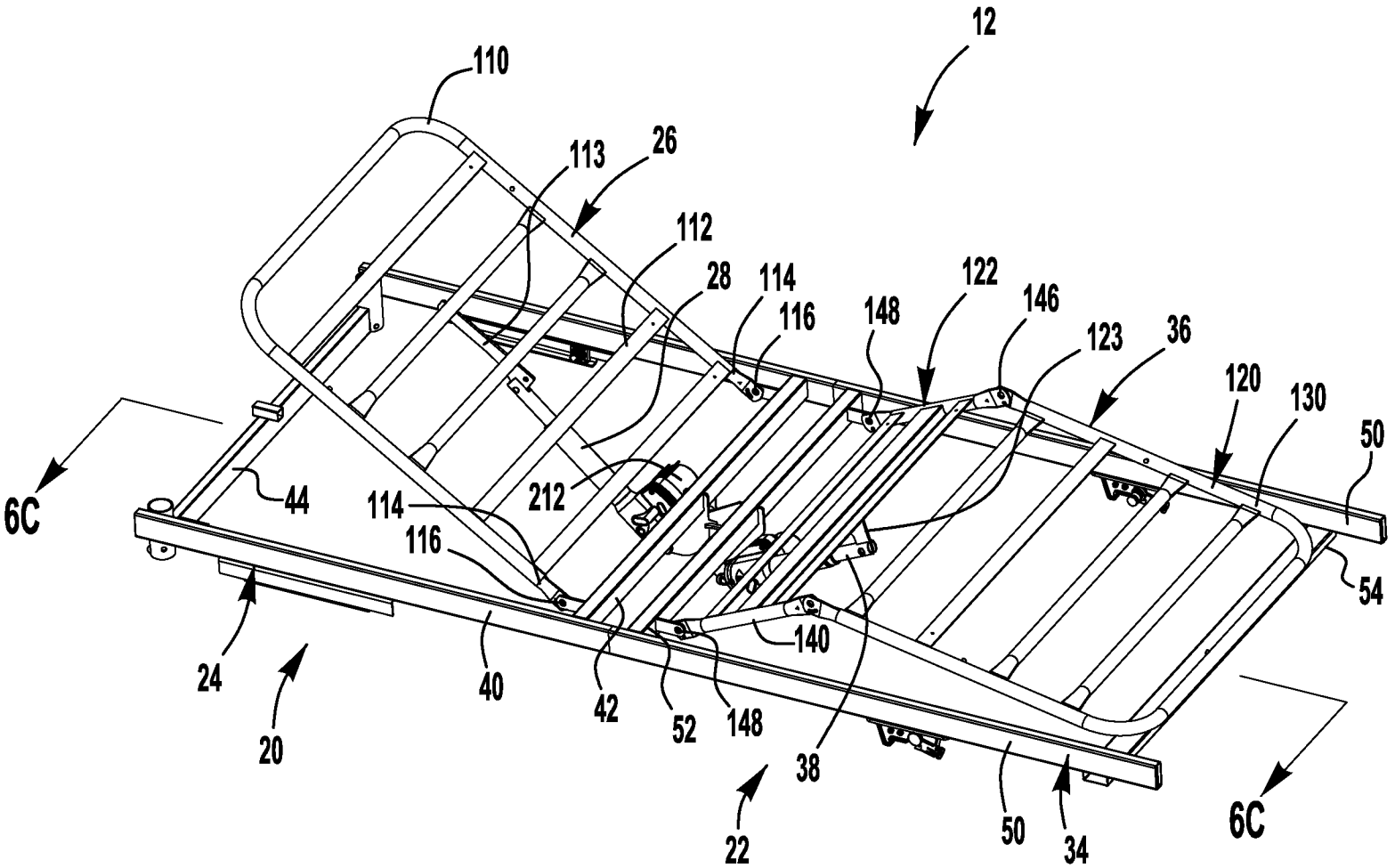
FIG. 6B is a perspective view of a bed platform of the bed illustrated by FIG. 5A.
Figure 6C:
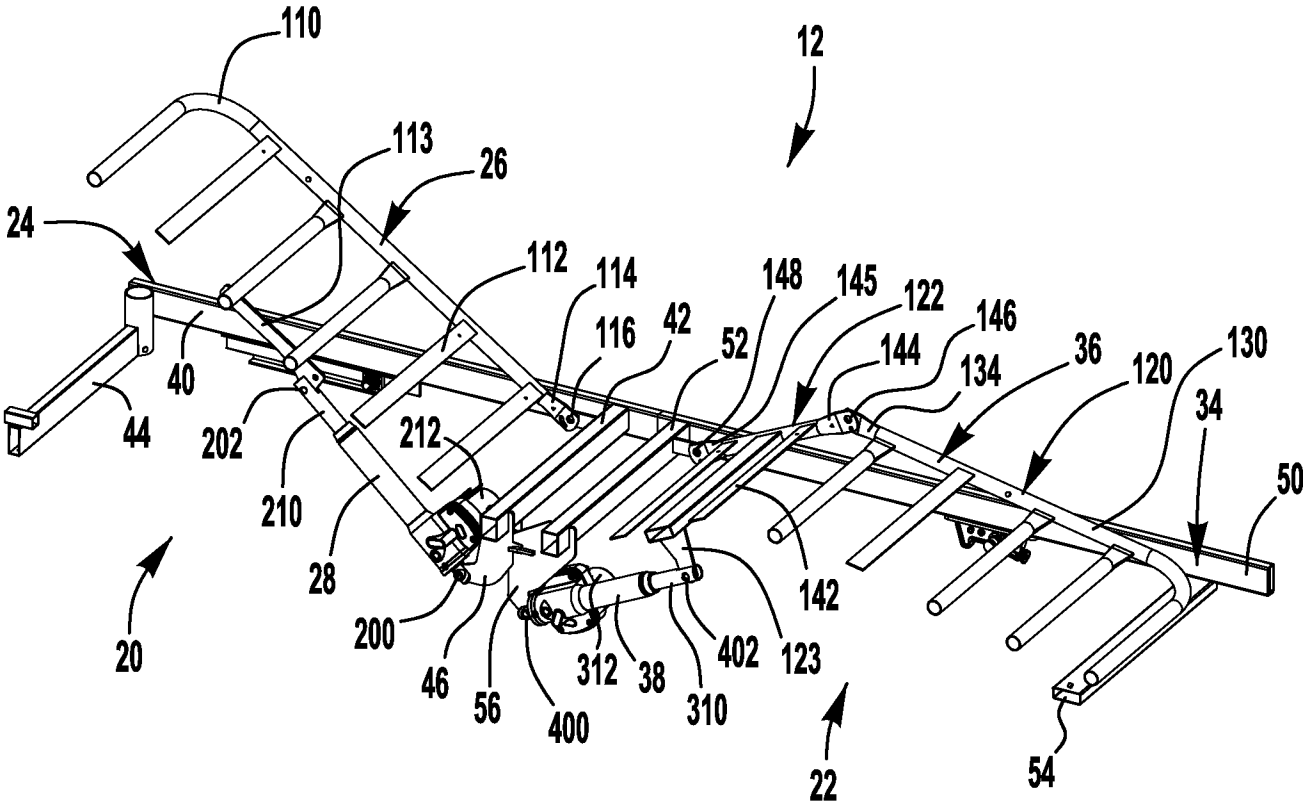
FIG. 6C is a sectioned perspective view with the section taken along the plane indicated by lines 6C-6C in FIG. 6B.
Figure 6D:
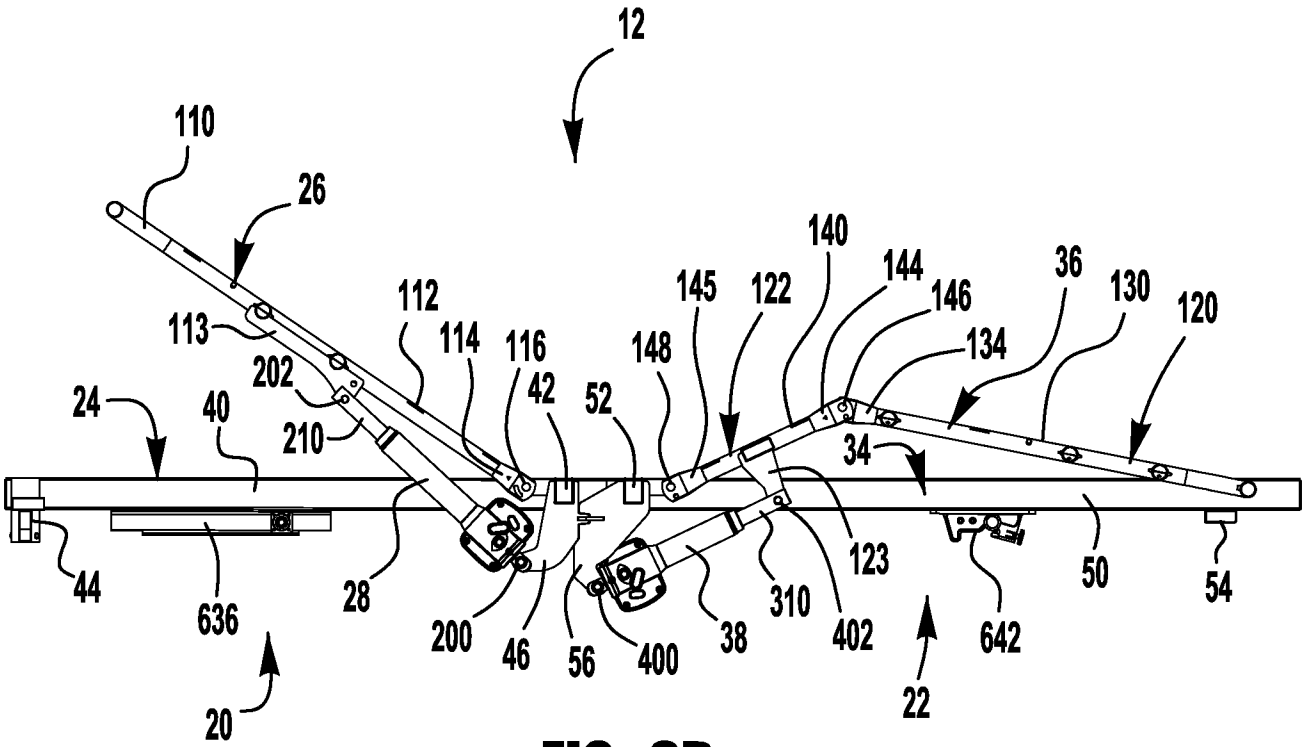
FIG. 6D is a sectional view with the section taken along the plane indicated by lines 6C-6C in FIG. 6B.
Figure 7A:
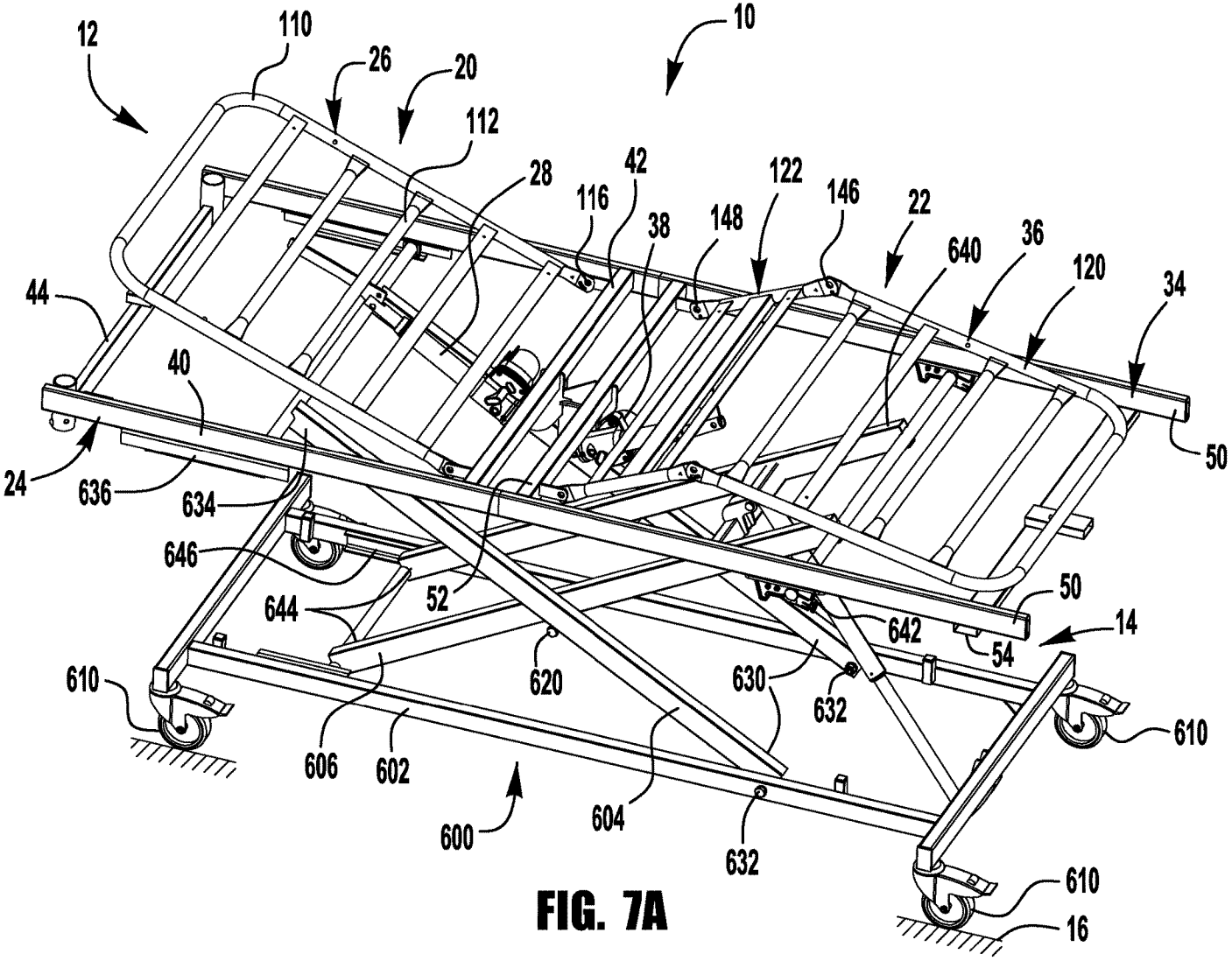
FIG. 7A is a view similar to the view of FIG. 6A where moveable mattress supports have been moved downward from the positions shown in FIG. 6A.
Figure 7B:
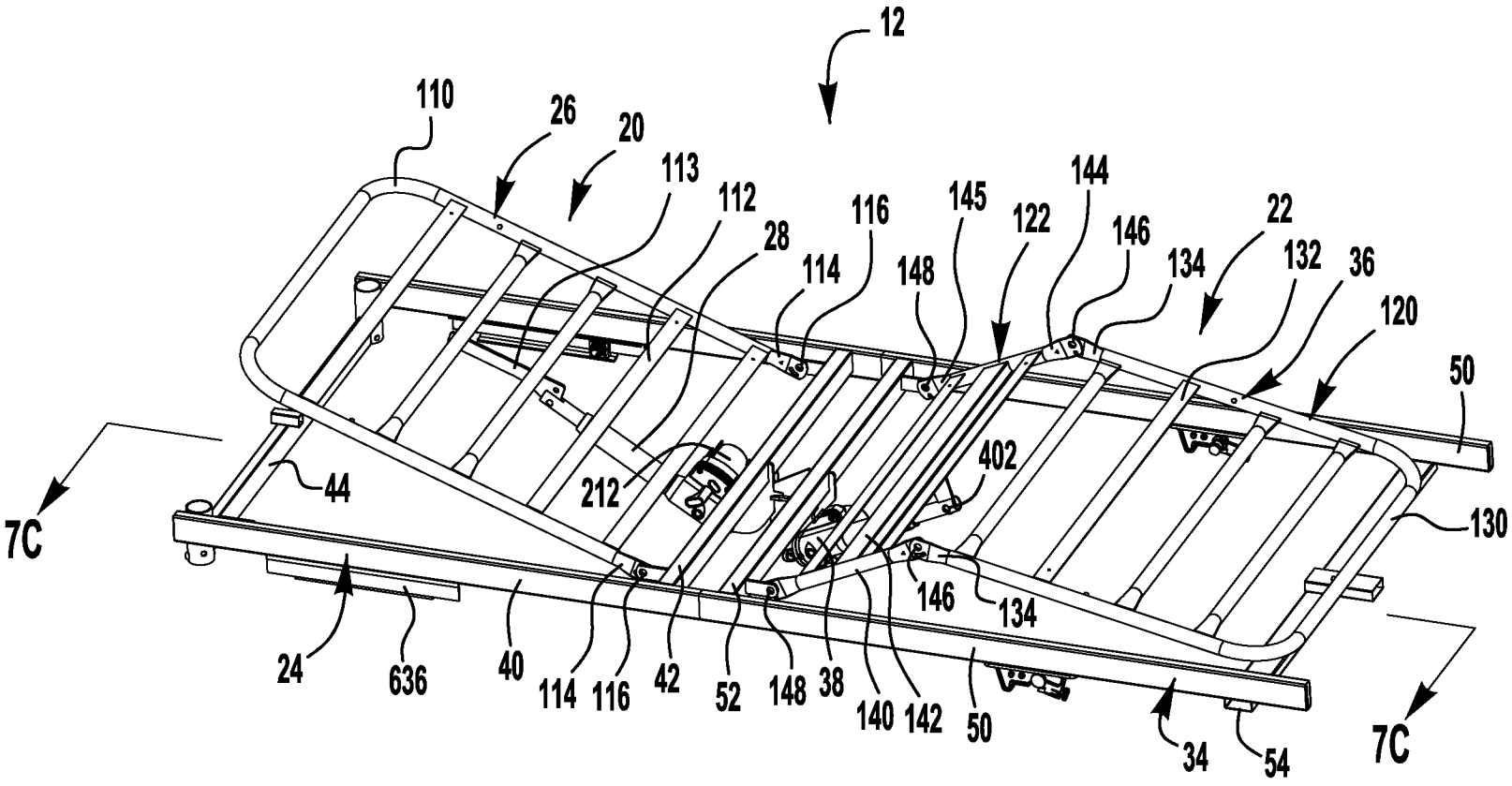
FIG. 7B is a perspective view of a bed platform of the bed illustrated by FIG. 7A.
Figure 7C:
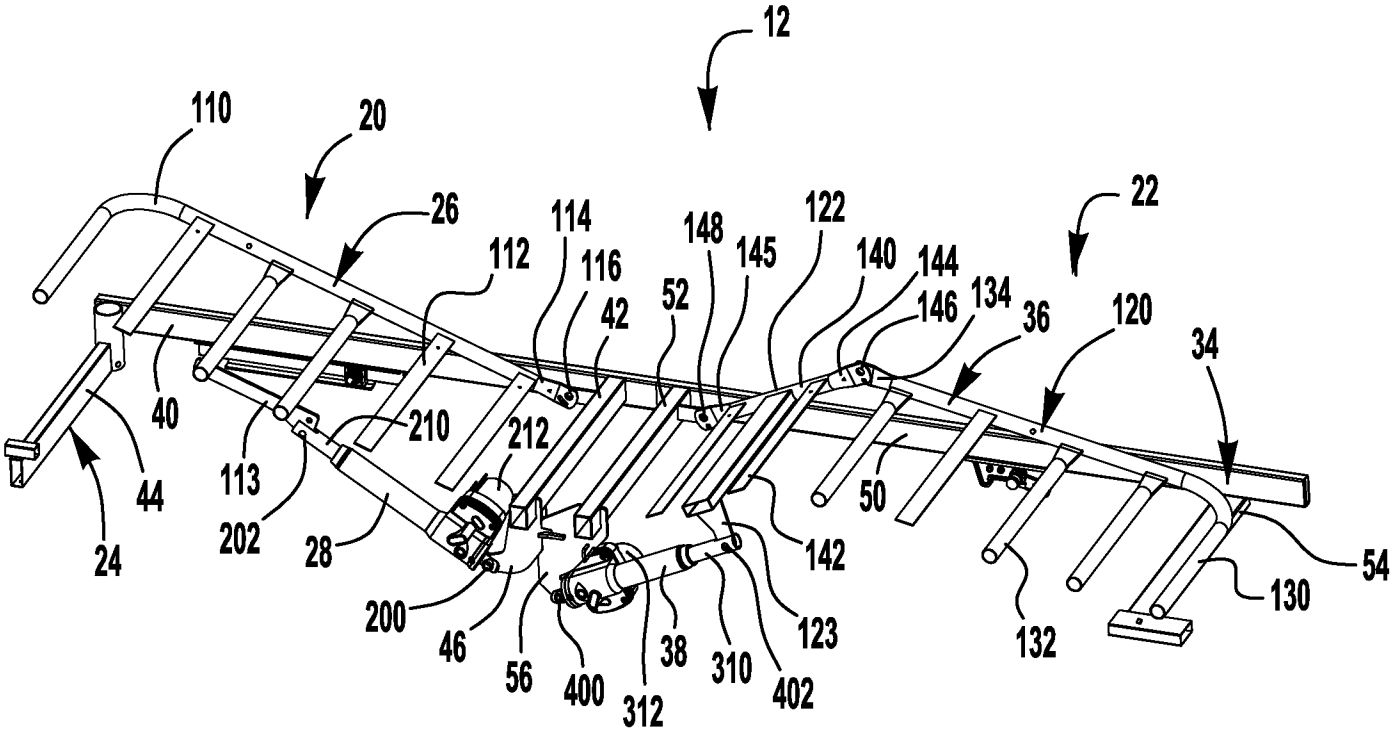
FIG. 7C is a sectioned perspective view with the section taken along the plane indicated by lines 7C-7C in FIG. 7B.
Figure 7D:
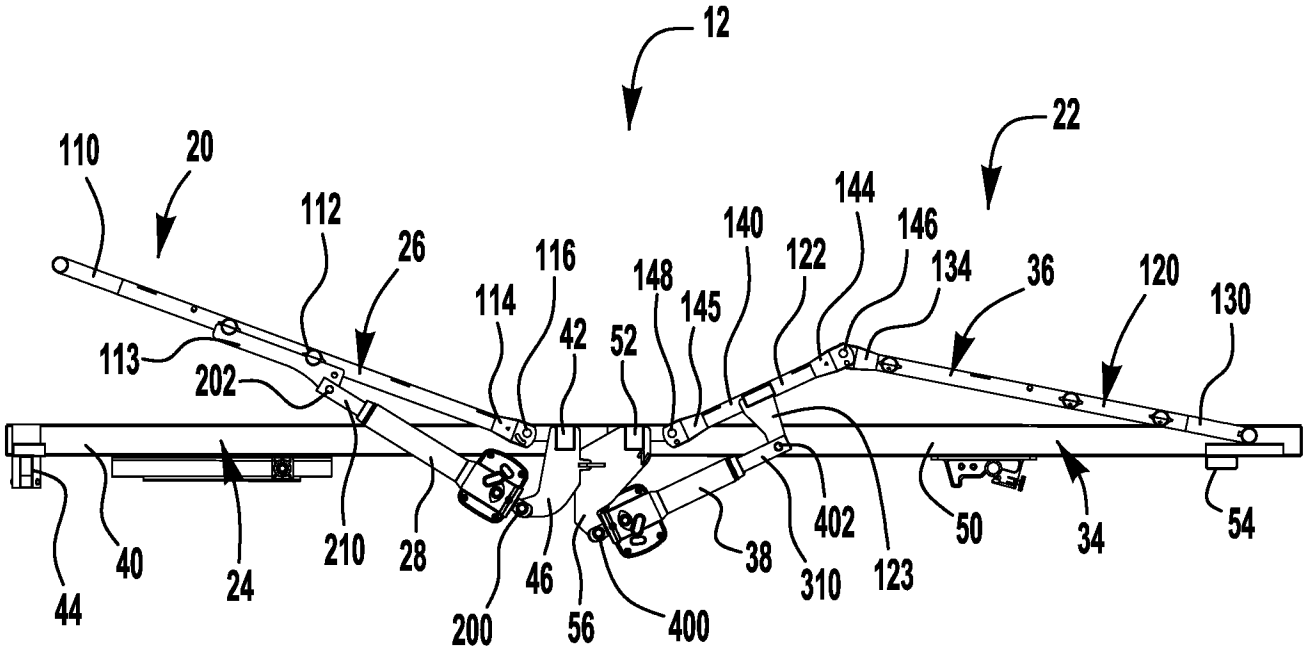
FIG. 7D is a sectional view with the section taken along the plane indicated by lines 7C-7C in FIG. 7B.
Figure 8A:
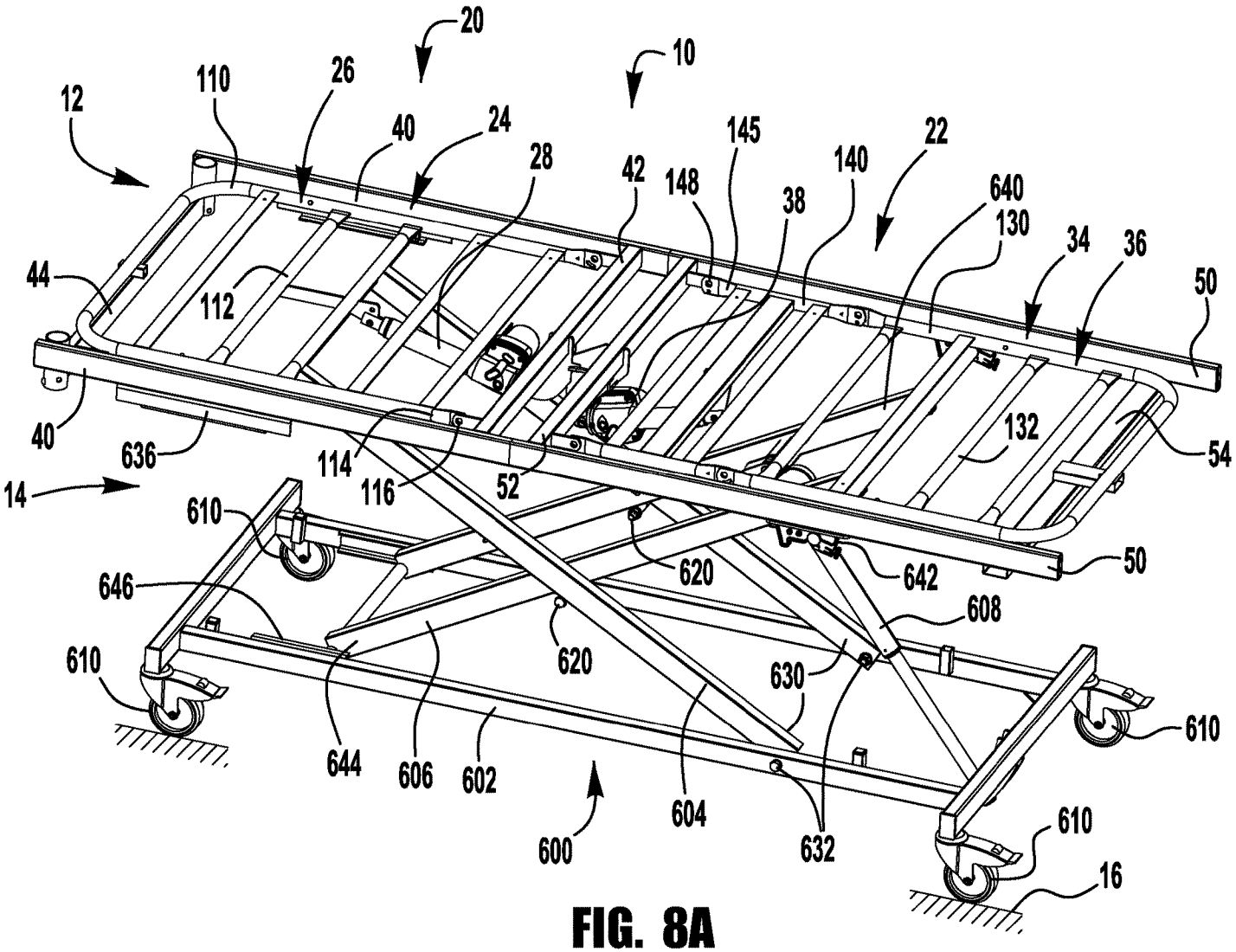
FIG. 8A is a view similar to the view of FIG. 7A where moveable mattress supports have been moved downward to neutral positions.
Figure 8B:
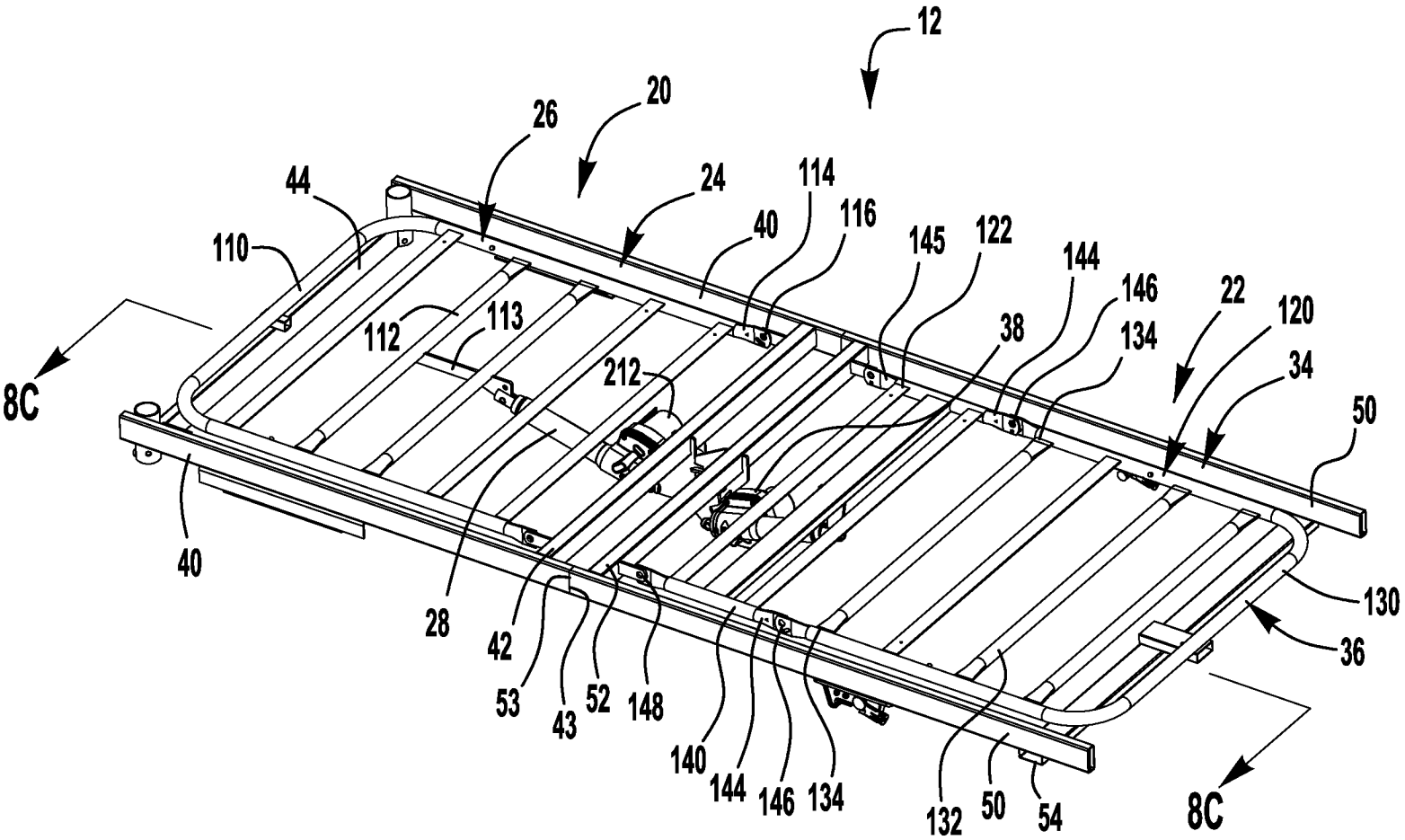
FIG. 8B is a perspective view of a bed platform of the bed illustrated by FIG. 8A.
Figure 8C:
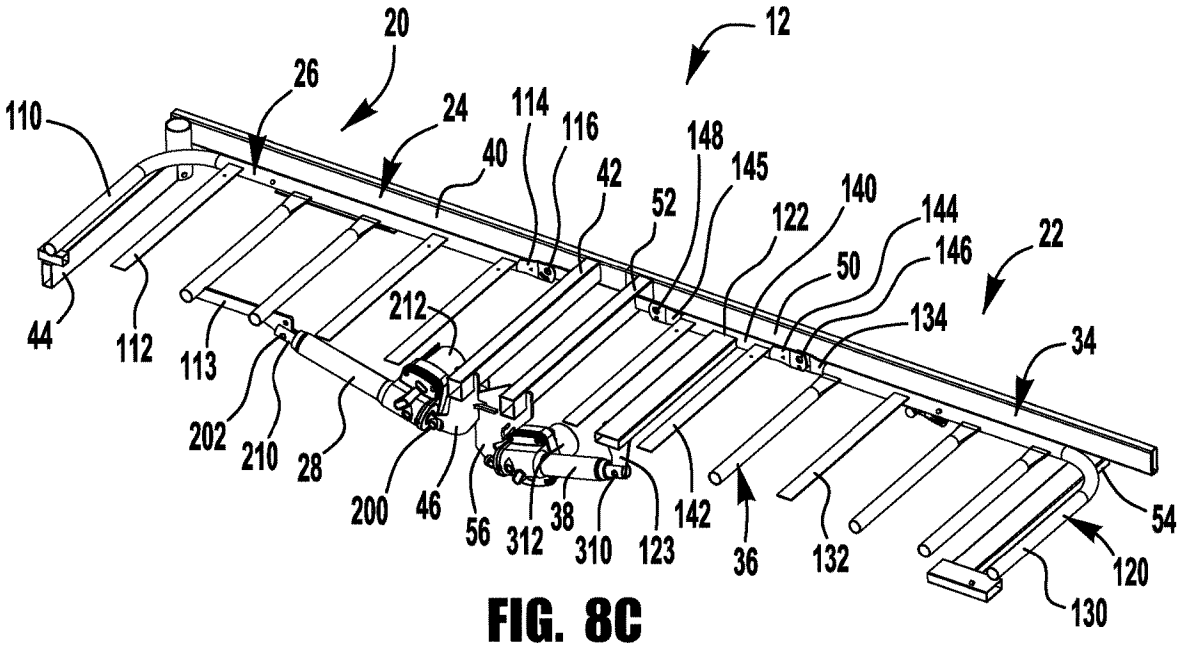
FIG. 8C is a sectioned perspective view with the section taken along the plane indicated by lines 8C-8C in FIG. 8B.
Figure 8D:
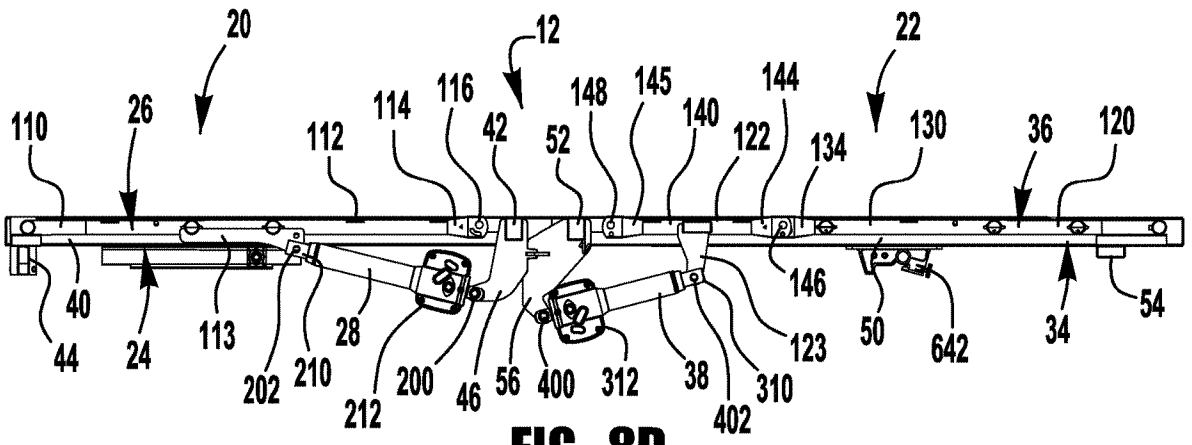
FIG. 8D is a sectional view with the section taken along the plane indicated by lines 8C-8C in FIG. 8B.

In the exemplary embodiment illustrated by FIG. 4, the actuator support member 46 of the head end support frame assembly 24 is coupled to a coupling member 48 that is separate from the actuator support member 34 of the foot end support frame assembly 34 to couple the actuator support member 34 to the cross member 52. The actuator support member 46 of the head end support frame assembly 24 telescopically engages the coupling member 48 that is attached to the cross member 52 of the foot end support frame assembly 34 when the head end support frame assembly 24 is assembled with the foot end support frame assembly 34. In the illustrated embodiment, a portion 70 of the actuator support member 46 of the head end support frame assembly 24 extends into and optionally abuts a portion 81 of the coupling member 48. The portions 70, 81 may be similar to the portions 70, 80 illustrated by FIG. 2. In the example illustrated by FIG. 4, the actuator support member 46 of the head end support frame assembly 24 is not aligned in the longitudinal direction L of the frame with the actuator support member 56 of the foot end support frame assembly 34 when the head end support frame assembly 24 is assembled with the foot end support frame assembly 34.

In the illustrated embodiments, the actuator support member 56 of the foot end support frame assembly 34 is coupled to the cross member 42 of the head end support frame assembly 24 when the head end platform section 20 is assembled with the foot end platform section 22. In another embodiment, the actuator support member 56 of the foot end support frame assembly 34 is coupled to a member other than the cross member 42 of the head end support frame assembly 24 when the head end platform section 20 is assembled with the foot end platform section 22. In another embodiment, the actuator support member 56 of the foot end support frame assembly 34 is not coupled to any member of the head end support frame assembly 24 when the head end platform section 20 is assembled with the foot end platform section 22.

The actuator support member 56 of the foot end support frame assembly 34 may be coupled to the cross member 42 of the head end support frame assembly 24 in a wide variety of different ways. Examples of suitable coupling arrangements include, but are not limited to, fasteners, such as pins, nuts, bolts, etc., quick connect arrangements, and telescoping arrangements. The actuator support member 56 of the foot end support frame assembly 34 may be directly coupled to the cross member 42 of the head end support frame assembly 24 or indirectly coupled to the cross member 42 of the head end support frame assembly 24 by one or more intermediate members (e.g., a coupling member 58, as shown in FIG. 4).

In the exemplary embodiment illustrated by FIG. 3, the actuator support member 56 of the foot end support frame assembly 34 is coupled to the actuator support member 24 of the head end support frame assembly 24 to couple the actuator support member of the foot end support frame assembly 34 to the cross member 42 of the head end support frame assembly 24. In one exemplary embodiment, assembling of the head end platform section 20 is assembled with the foot end platform section 22 automatically couples the actuator support member 46 to the actuator support member 56. In the embodiment illustrated by FIG. 3, the actuator support member 46 of the head end support frame assembly 24 is coupled to the actuator support member 56 of the foot end support frame assembly 34 to couple the actuator support member 46 to the cross member 52 and to couple the actuator support member 56 to the cross member 42 when the head end support frame assembly 24 is assembled with the foot end support frame assembly 34.

In the exemplary embodiment illustrated by FIG. 4, the actuator support member 56 of the foot end support frame assembly 34 is coupled to a coupling member 58 that is separate from the actuator support member 46 of the head end support frame assembly 24 to couple the actuator support member 56 to the cross member 42. The actuator support member 56 of the head end support frame assembly 24 telescopically engages the coupling member 58 that is attached to the cross member 42 of the head end support frame assembly 24 when the head end support frame assembly 24 is assembled with the foot end support frame assembly 34. In the illustrated embodiment, a portion 71 of the coupling member 58 extends into and optionally abuts a portion 80 of the actuator support member 56. The portions 71, 80 may be similar to the portions 70, 80 illustrated by FIG. 2.

The head end moveable mattress support 26 can take a wide variety of different forms. Any structure capable of supporting and positioning a head end of a mattress (not shown) can be used as the head end moveable mattress support 26. The head end moveable mattress support 26 can be coupled to the head end support frame assembly 24 in a wide variety of different ways. Any coupling that allows the head end moveable mattress support 26 to be moved between a neutral position (which may, but need not, be substantially flat, see FIGS. 8A-8D) and an elevated position (see FIGS. 5A-5D) can be used.

In the illustrated embodiment, the head end moveable mattress support 26 comprises a u-shaped outer frame 110 and mattress support slats 112 extending across the frame 110. A head end actuator mounting bracket 113 is mounted to the back side of the mattress support slats 112. End portions 114 of the frame 110 are pivotally connected to the head end support frame assembly 24 at pivot connections 116. As such, the head end moveable mattress support 26 can pivot between the elevated position shown by FIGS. 5A-5D and the neutral position illustrated by FIGS. 8A-8D.

The foot end moveable mattress support 36 can take a wide variety of different forms. Any structure capable of supporting and positioning a foot end of a mattress (not shown) can be used as the foot end moveable mattress support 36. The foot end moveable mattress support 36 can be coupled to the foot end support frame assembly 34 in a wide variety of different ways. Any coupling that allows the foot end moveable mattress support 36 to be moved between a neutral position (See FIGS. 8A-8D) and an elevated position (See FIGS. 5A-5D) can be used.

Figure 1B:
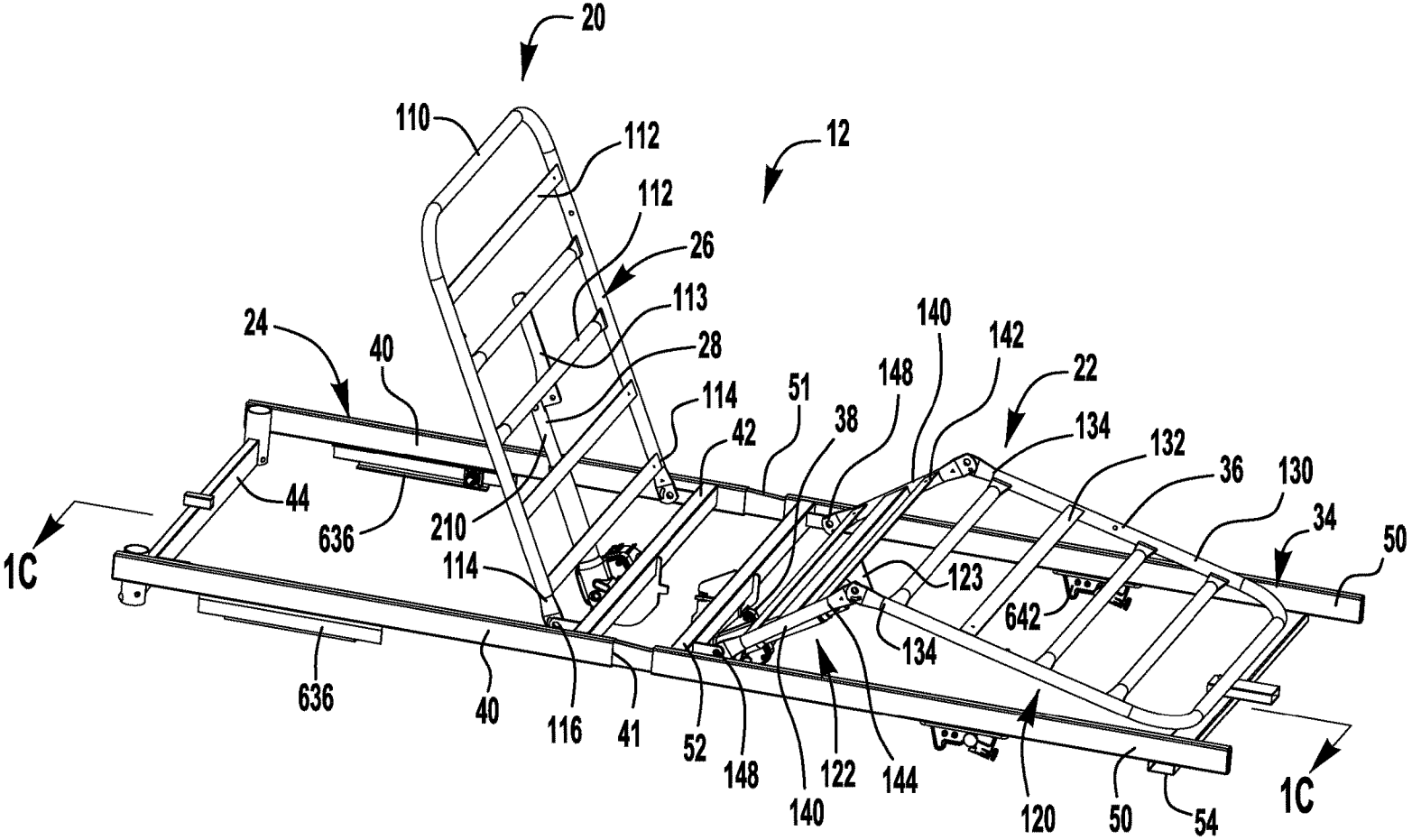
FIG. 1B is a perspective view of a bed platform of the bed illustrated by FIG. 1A.
Figure 1C:
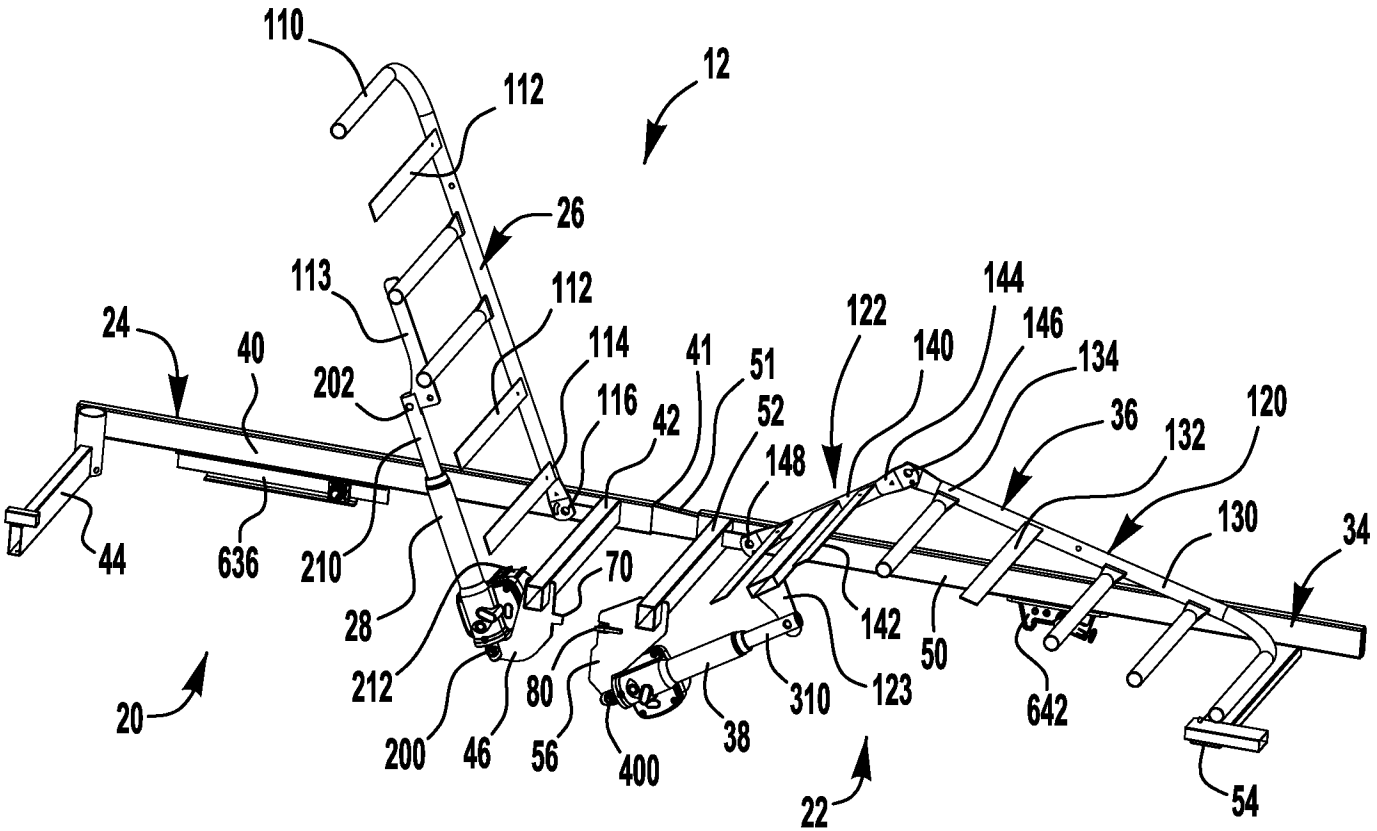
FIG. 1C is a sectioned perspective view with the section taken along the plane indicated by lines 1C-1C in FIG. 1B.
Figure 1D:
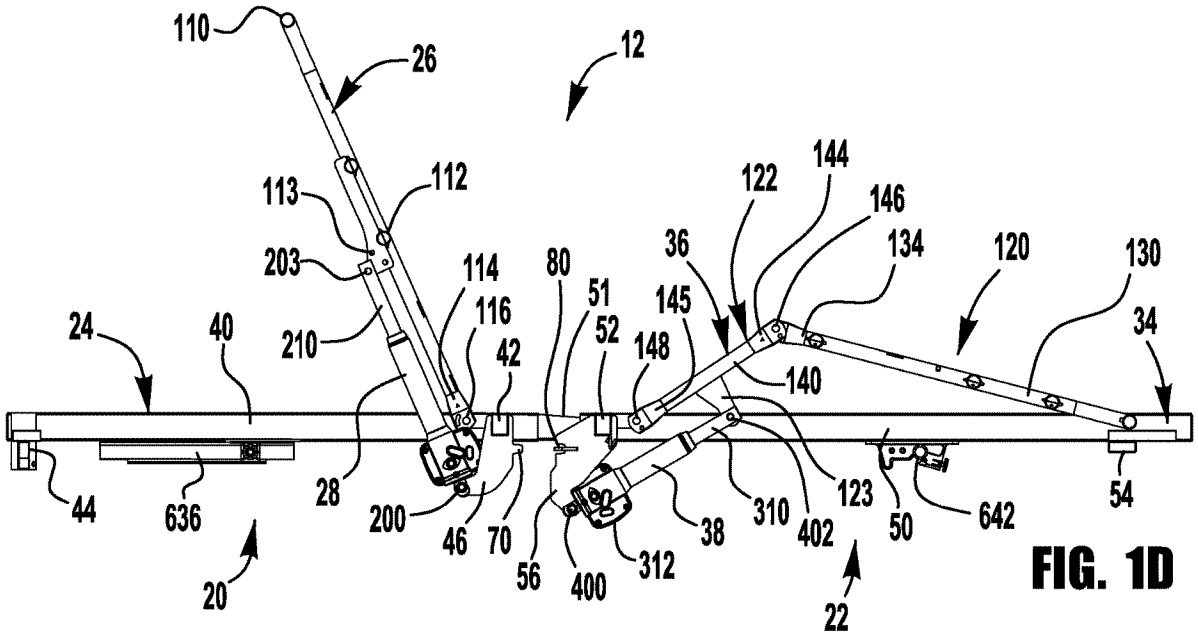
FIG. 1D is a sectional view with the section taken along the plane indicated by lines 1C-1C in FIG. 1B.

In the illustrated embodiment, the foot end moveable mattress support 36 includes two sections 120, 122 that are pivotally connected together. Referring to FIG. 1B, the first section 120 includes a u-shaped outer frame 130 and mattress support slats 132 extending across the frame 130. The second section 122 includes spaced apart parallel frame members 140 and mattress support slats 142 extending between the frame members 140. Referring to FIG. 1C, an actuator mounting bracket 123 is mounted to the back side of the mattress support slats 142. End portions 134 of the first frame section 120 are pivotally connected to end portions 144 of the second frame section 122 at pivot connections 146. The first and second frame sections 120, 122 are pivotally coupled at or near the expected position of an occupant's knee area to follow the natural contours of a person. Referring to FIG. 1D, end portions 145 of the second frame section 122 are pivotally connected to the foot end support frame assembly 34 at pivot connections 148. As such, the foot end moveable mattress support 36 can move between the elevated position shown by FIGS. 5A-5D and the neutral position illustrated by FIGS. 8A-8D.

The head end actuator 28 can take a wide variety of different forms. Any arrangement capable of moving the head end moveable mattress support 26 between the neutral position (see FIGS. 8A-8D) and the elevated position (see FIGS. 5A-5D) can be used. Examples of head end actuators include, but are not limited to electric actuators, hydraulic actuators, pneumatic actuators, pulley and cable arrangements, gear arrangements, nut and shaft arrangements, combinations and sub-combinations of any of these arrangements, and the like. In the illustrated embodiment, the head end actuator 28 includes an extendable/retractable shaft 210. The force required to extend and retract the shaft can be provided in a variety of different ways. For example, the shaft may be extended and retracted with a motor, hydraulic fluid, air, magnetic force, and/or a spring, or any combination thereof. In the illustrated embodiment, the shaft 210 is extended and retracted by operation of an electric motor 212.

Figure 9:
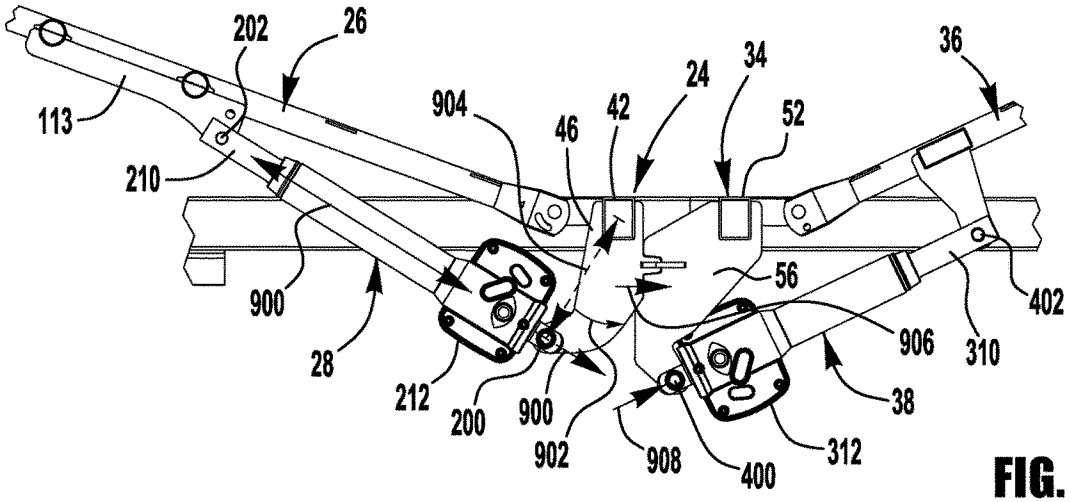
FIG. 9 is an enlarged portion of FIG. 6D illustrating forces applied by a head end actuator.

In the illustrated exemplary embodiment, the head end actuator 28 is coupled to the actuator support member 46 of the head end support frame assembly 24 and to the head end moveable mattress support 26 for moving the head end moveable mattress support 26 between the neutral position (see FIGS. 8A-8D) and the elevated position (See FIGS. 5A-5D). The head end actuator 28 may be coupled to the actuator support member 46 and to the head end moveable mattress support 26 in a wide variety of different ways. In the illustrated examples, the head end actuator 28 is coupled to the actuator support member 46 and to the actuator mounting bracket 113. The head end actuator 28 may be coupled to the actuator support member 46 and to the actuator mounting bracket 113 in a wide variety of different ways. Referring to FIG. 9, in the illustrated embodiment, the head end actuator 28 is pivotally connected to the actuator support member 46 at a pivot axis 200 and is pivotally connected to the actuator mounting bracket 113 at a pivot axis 202. In the illustrated embodiment, extension of the head end actuator 28 moves the head end moveable mattress support 26 toward the elevated position shown in FIGS. 5A-5D and retraction of the head end actuator 28 moves the head end moveable mattress support 26 toward the neutral position shown in FIGS. 8A-8D. However, other actuator arrangements may move the head end moveable mattress support 26 in other manners.

Referring to FIG. 9, when the head end actuator 28 is operated to move the head end moveable mattress support 26 toward the elevated position shown in FIGS. 5A-5D, the head end actuator 28 applies force in the direction indicated by arrow 900. This force 900 is applied to the actuator support member 46 at the pivot axis 200 and is transferred to the cross member 42 to which the actuator support member 46 is attached. Since the pivot axis 200 is spaced apart from the cross member 42 a distance 904, torque 902 is applied to the cross member 42. In an exemplary embodiment, a portion of the force 900 indicated by arrow 906 is transferred to the cross member 52 of the foot end support frame assembly 34. In the example illustrated by FIG. 3, the portion 906 of the force 900 is transferred from the actuator support member 46 to the cross member 52 through the actuator support member 56 of the foot end support frame assembly 34. Since the cross member 52 supports some of the force, the force 900 and torque 902 that the actuator support member 46 and the cross member 42 of the head end frame assembly 24 can withstand is increased. Since the head and foot end actuators 28, 38 are in-line, a portion 908 of the force 900 may also be transferred to the foot end actuator 38 and the foot end moveable mattress support 36. In the example illustrated by FIG. 4, the portion of the force 900 is transferred from the actuator support member 46 to the cross member 52 in the same manner, except the actuators 28, 38 are not in line and the transfer is through the coupling member 48 instead of through the actuator support member 56 of the foot end support frame assembly 34.

The foot end actuator 38 can take a wide variety of different forms. Any arrangement capable of moving the foot end moveable mattress support 36 between the neutral position (see FIGS. 8A-8D) and the elevated position (see FIGS. 5A-5D) can be used. Examples of foot end actuators include, but are not limited to electric actuators, hydraulic actuators, pneumatic actuators, pulley and cable arrangements, gear arrangements, nut and shaft arrangements, combinations and sub-combinations of any of these arrangements, and the like. In the illustrated embodiment, the foot end actuator 38 includes an extendable/retractable shaft 310. The force required to extend and retract the shaft can be provided in a variety of different ways. For example, the shaft may be extended and retracted with a motor, hydraulic fluid, air, magnetic force, and/or a spring, and any combination thereof. In the illustrated embodiment, the shaft 310 is extended and retracted by operation of a motor 312.

In the illustrated exemplary embodiment, the foot end actuator 38 is coupled to the actuator support member 56 of the foot end support frame assembly 34 and to the foot end moveable mattress support 36 for moving the foot end moveable mattress support 36 between the neutral position (see FIGS. 8A-8D) and the elevated position (See FIGS. 5A-5D). The foot end actuator 38 may be coupled to the actuator support member 56 and to the foot end moveable mattress support 36 in a wide variety of different ways. In the illustrated examples, the foot end actuator 38 is coupled to the actuator support member 56 and to the actuator mounting bracket 123. The foot end actuator 38 may be coupled to the actuator support member 56 and to the actuator mounting bracket 123 in a wide variety of different ways. In the illustrated embodiment, the foot end actuator 38 is pivotally connected to the actuator support member 56 at a pivot axis 400 and is pivotally connected to the actuator mounting bracket 123 at a pivot axis 402. In the illustrated embodiment, extension of the foot end actuator 38 moves the foot end moveable mattress support 36 toward the elevated position shown in FIGS. 5A-5D and retraction of the foot end actuator 38 moves the foot end moveable mattress support 36 toward the neutral position shown in FIGS. 8A-8D. However, other actuator arrangements may move the foot end moveable mattress support 36 in other manners.

Figure 10:
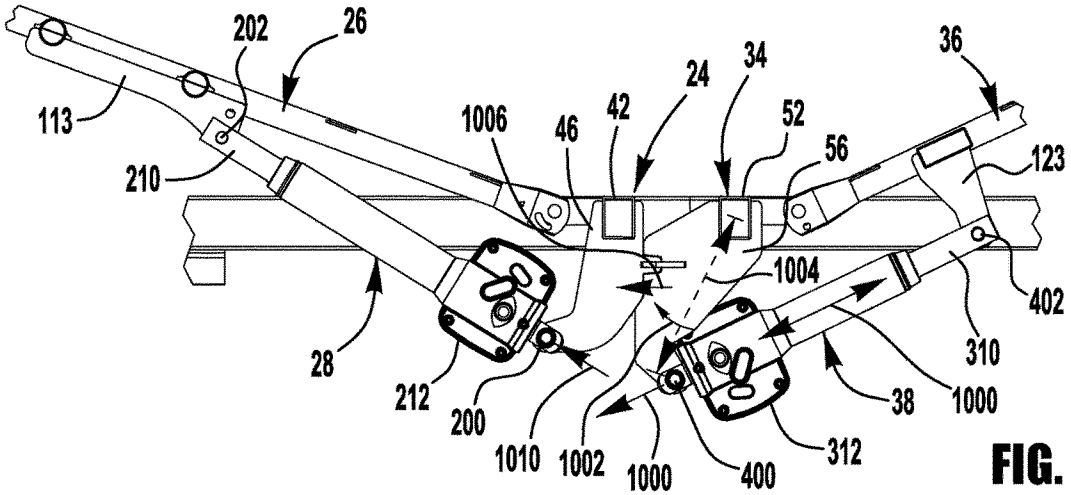
FIG. 10 is an enlarged portion of FIG. 6D illustrating forces applied by a foot end actuator.

Referring to FIG. 10, when the foot end actuator 38 is operated to move the foot end moveable mattress support 36 toward the elevated position shown in FIGS. 5A-5D, the foot end actuator 38 applies force in the direction indicated by arrow 1000. This force 1000 is applied to the actuator support member 56 at the pivot axis 400 and is transferred to the cross member 52 to which the actuator support member 56 is attached. Since the pivot axis 300 is spaced apart from the cross member 52 by a distance 1004, torque 1002 is applied to the cross member 52. In an exemplary embodiment, a portion 1006 of the force 1000 is transferred to the cross member 42 of the head end support frame assembly 24. In the example illustrated by FIG. 3, the portion 1006 of the force 1000 is transferred from the actuator support member 56 to the cross member 42 through the actuator support member 46 of the head end support frame assembly 24. Since the cross member 42 supports some of the force, the force 1000 and torque 1002 that the actuator support member 56 and the cross member 52 of the foot end frame assembly 34 can withstand is increased. Since the head and foot end actuators 28, 38 are in-line, a portion of the force 1000 may also be transferred as indicated by arrow 1010 to the head end actuator 28 and the head end moveable mattress support 26. In the example illustrated by FIG. 4, the portion 1006 of the force 1000 is transferred from the actuator support member 56 to the cross member 42 in the same manner, except the actuators 28, 38 are not in line and the transfer is through the coupling member 58 instead of through the actuator support member 46 of the head end support frame assembly 24.

The base 14 supports the bed platform 12 above the support surface 16. The base 14 can take a wide variety of different forms. In the illustrated embodiment, the base 14 is configured to raise and lower the bed platform 12 with respect to the support surface 16. The base 14 can be configured to raise and lower the bed platform 12 with respect to the support surface 16 in a wide variety of different ways. Any lift mechanism can be used.

In the illustrated embodiment, the base 14 includes a scissor lift mechanism 600. The scissor lift mechanism includes a bottom support frame 602, a first pair of support legs 604, a second pair of support legs 606, and an extendable and retractable actuator 608. The bottom support frame 602 is optionally supported on the support surface 16 by wheels 610, such as casters. The first pair of support legs 604 are pivotably connected to the second pair of support legs 606 at a pivot connection 620, such that the legs 604, 606 farm a crossed or "scissor" configuration. A lower end 630 of the first pair of legs 604 is pivotably connected to the bottom support frame 602 at a pivot connection 632. An upper end 634 is slidably coupled to a track 636 that is connected to the bed platform 12. An upper end 640 of the second pair of legs 606 is pivotably connected to the bed platform at a pivot connection 642. A lower end 644 is slidably coupled to a track 646 that is connected to the bottom support frame. The extendable and retractable actuator 608 is coupled between the bottom support frame 602 and the second pair of legs 606, such that when the actuator extends the bed platform 12 raises and when the actuator retracts the bed platform lowers. However, actuator can be configured in other manners. For example, the actuator 608 can be coupled between upper or lower portions of the legs 604, 606, such that extension lowers the bed platform 12 and retraction raises the bed platform.

An adjustable bed, as described herein, may include an adjustment control system operable to independently adjust head and foot end moveable mattress supports, for example, for separate tilting adjustment of the head and foot end sections of the mattress. As one example, an adjustable bed including separate head end and foot end actuators (e.g. hand crank actuators, electromechanical actuators, etc.) may include a controller having one or more controls (e.g., buttons, switches, hand cranks, etc.) for separately operating the head and foot end actuators for selective adjustment of the corresponding head and foot end sections of the mattress. Additionally or alternatively, an adjustable bed including separate head end and foot end actuators may include a controller having controls (e.g., buttons, switches, hand cranks, etc.) for simultaneously or synchronously operating the head and foot end actuators for simultaneous or synchronous adjustment of the corresponding head and foot end sections of the mattress. In one such example, an adjustable bed may be configured such that the head and foot end sections simultaneously or synchronously adjust in a predetermined relationship in response to user operation of a control component. For example, an angular adjustment of the head section of X degrees from a neutral (e.g., horizontal, flat, or low elevation/incline) position may be configured to correspond with an angular adjustment of the foot section of Y degrees from a neutral (e.g., horizontal, flat, or low elevation/incline) position. As one example, an adjustment control system may be configured to raise or incline the foot end section of the mattress when the head end section is raised, to prevent an occupant of the bed from sliding down the inclined head end section of the bed.

In an exemplary embodiment, an adjustment control system for synchronously operating adjustable head and foot end sections of a bed includes an electronic control circuit programmed to power electromechanical head and foot end actuators for a predetermined output (e.g., torque, duration, etc.) to position the head and foot end sections in desired angled positions in response to user operation of one or more controls. The adjustment control system may, for example, utilize one or more limit switches to terminate power to the electromechanical head and foot end actuators when the desired angled positions of the head and foot end sections have been reached. Additionally or alternatively, power to the electromechanical head and foot end actuators may be terminated by user operation of the one or more controls.

In another exemplary embodiment, a first end actuator (e.g., one of the head and foot end actuators) may comprise a powered actuator (e.g., control-driven electromechanical, pneumatic, or hydraulic or hand crank mechanical actuator) that adjusts a corresponding first end section (e.g., the corresponding one of the head and foot end sections), and a second end actuator (e.g., the other of the head end and foot end actuators) may comprise a linking actuator (e.g., cable and pulley arrangement, pivotally connected bar linkage, gear driven arrangement) mechanically connected with the first end section for automatic operation of the second end section in response to movement of the first end section. The linking arrangement may be configured to adjust the second end section in a predetermined relationship with the adjustment of the first end section by the first end actuator.

Figure 11A:
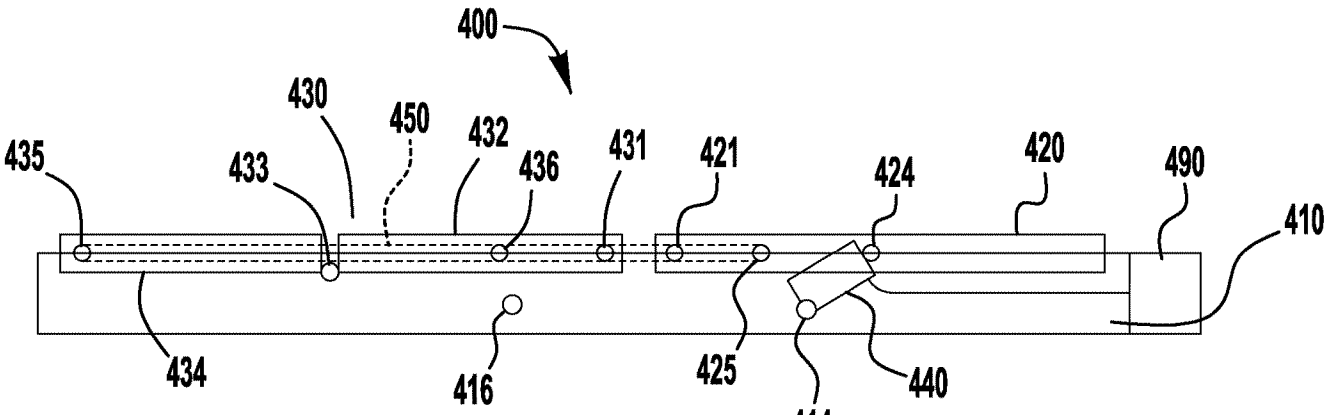
FIG. 11A is a side schematic view of an exemplary embodiment of an adjustable bed, shown with end sections in a neutral position.
Figure 11B:
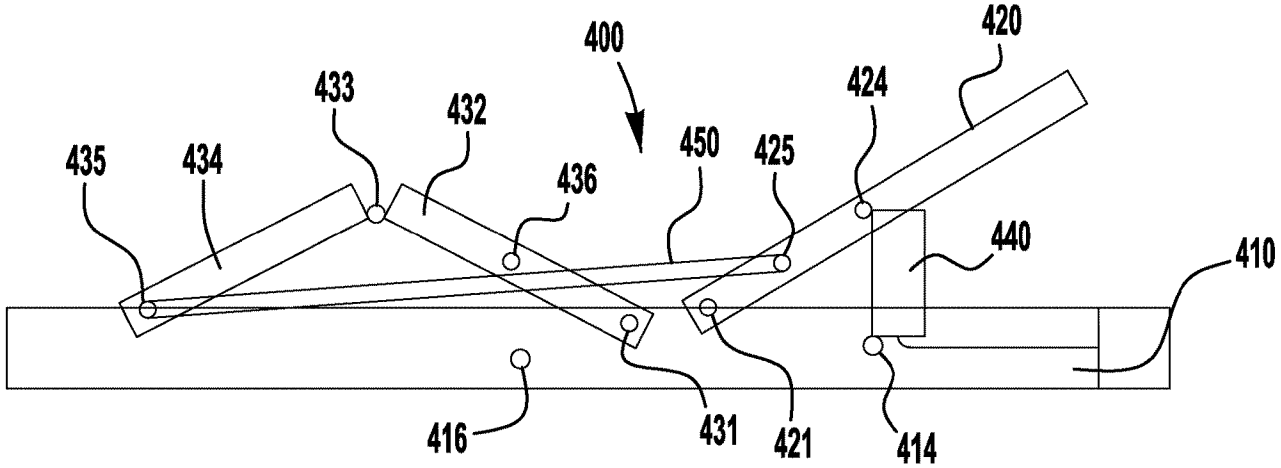
FIG. 11B is a side schematic view of the adjustable bed of FIG. 11A, shown with the end sections in an elevated position.

FIGS. 11A and 11B schematically illustrate an exemplary adjustable bed 400 having a support frame 410 and first and second end sections 420, 430 each pivotable with respect to the support frame 410 about pivot connections 421, 431. A powered actuator 440 is coupled to the support frame 410 (e.g., at a first powered actuator mount 414 disposed on a side member or central crossing member of the support frame 410) and to the first end section 420 (e.g., at a second powered actuator mount 424 disposed on a side member or central crossing member of the first end section) for moving the first end section 420 between a first position (e.g., flat or other neutral position, as shown in FIG. 11A) and a second position (e.g., angled or elevated position, as shown in FIG. 11B). The powered actuator 440 may comprise, for example, an electromechanical actuator powered and controlled by a controller 490 (which may, but need not, be secured to the bed). A linking actuator 450 is mechanically coupled to the first end section 420 (e.g., at a first linking actuator mount 425) and to the second end section 430 (e.g., at a second linking actuator mount 435), such that movement of the first end section 420 from the first position to the second position (e.g., by actuation of the first end actuator 440 in response to user operation of the controller 490) causes the second end actuator 450 to move the second end section 430 from a first position (e.g., flat or other neutral position, as shown in FIG. 11A) to a second position (e.g., angled or elevated position, as shown in FIG. 11B). The linking actuator 450 may include, for example, any mechanical linkage configured to impart a pivoting force to the second end section 430 in response to pivoting movement of the first end section 420, including, for example, a mechanical gear driven mechanism, a multiple bar linkage, or a cable linkage.

While the first and second adjustable sections 420, 430 may be provided in many different configurations, in the illustrated example, the first end section 420 includes a single pivoting member (e.g., to provide an inclined head end section for and adjustable bed) and the second section 430 includes inner/proximal and outer/distal pivoting members 432, 434 pivotally connected to each other at pivot connection 436 to allow for a centrally elevated section (e.g., to accommodate the contours of raised legs with bent knees). In the illustrated embodiment, the linking actuator 450 is connected to the outer pivoting member 434 of the second section, such that movement of the first end section 420 transmits tension through the linking actuator 450 to pull the outer pivoting member 434 towards the first end section, forcing the second end section 430 to "fold" upward about the pivot connection 435, as shown in FIG. 11B.

The linking actuator may include many different mechanical linkage mechanisms. In an exemplary embodiment, the linking actuator includes a cable having a first end connected to the first end section and a second end connected to the second end section. One or more pulleys or other such cable directing members may be utilized to direct the cable linkage such that movement of the first end section from a first position to a second position applies tension to the cable to pull the second end section from a first position to a second position.

FIGS. 12A-13C illustrate an exemplary adjustable bed 10' which may, but need not, be similar to the exemplary adjustable beds 10 of FIGS. 1A-10, including head end and foot end platform sections 20', 22' each having a support frame assembly 24', 34', a moveable mattress support 26', 36', and an actuator 28', 39'; and a base 14' including a scissor lift mechanism 600'. The powered head end actuator 28' includes an extendable/retractable shaft 210' (or other suitable driven portion) driven by an electric motor 212' (or other suitable driving portion), similar to the embodiments of FIGS. 1A-10. The linking foot end actuator 39' includes a cable 320' connected with the head end mattress support 26' at a first end 321' and with the foot end mattress support 36' at a second end 322'. While the cable 320' may be connected with the mattress supports 26', 36' at a variety of locations using a variety of structures (e.g., fasteners, clips, or direct attachment to a support member), in the illustrated embodiment, the first end 321' of the cable 320' is secured to the head end actuator mounting bracket 113' (e.g., at a first linking actuator mount) and the second end 322' of the cable 320' is secured to a foot end cable mounting bracket 115' (e.g., at a first linking actuator mount) affixed to the first section 120' of the foot end mattress support 36'. The cable 320' is retained and guided by a first cable directing member 224' (e.g., pulley) disposed on the upper end 640' of the second pair of legs 606', and a second cable directing member 226' (e.g., pulley) disposed on the actuator support member 46' of the head end support frame assembly 24'. The cable directing members may include rigid components (e.g., cross-bars, loops, or fasteners, which may be cylindrical and/or low-friction coated to reduce cable wear and/or reduce required actuation forces) around which the cable extends to be appropriately redirected for the application of a directed tension force to the foot end mattress support. In the illustrated embodiment, as shown in FIG. 12C, pulleys 224', 226' are rotatably supported on a cylindrical mattress support slat 112' and cross member 52' (by bracket 225'), respectively, thereby reducing friction on the cable 320' during actuation.

While the cable 320' and cable directing members 224', 226' may be positioned proximate either side of the bed 10', in the illustrated embodiment, the cable 320' and cable directing members 224', 226' are positioned along a central portion of the bed under the head and foot sections of the bed. The first end 321' of the exemplary cable 320' extends from the head end actuator mounting bracket 113' under the second pulley 226' (or below an axis defined by the pivot points of the first and second pulleys 224', 226') to engage an under side of the pulley 226', such that raising the head end mattress support 26' applies a pulling force on the cable 320'. The portion of the cable between the second pulley 226' and the foot end cable mounting bracket 115' extends over the first pulley 224' (or above an axis defined by the pivot points of the first and second pulleys 224', 226') to engage an upper side of the pulley 224', such that when the head end mattress support 26' applies a pulling force on the cable 320', the second end 322' of the cable pulls the foot end cable mounting bracket 115' and the first section 120' of the foot end mattress support 36' to pivot the first and second sections 120', 122' of the foot end mattress support 36' about the pivot connections 146', 148'.

Figure 12A:
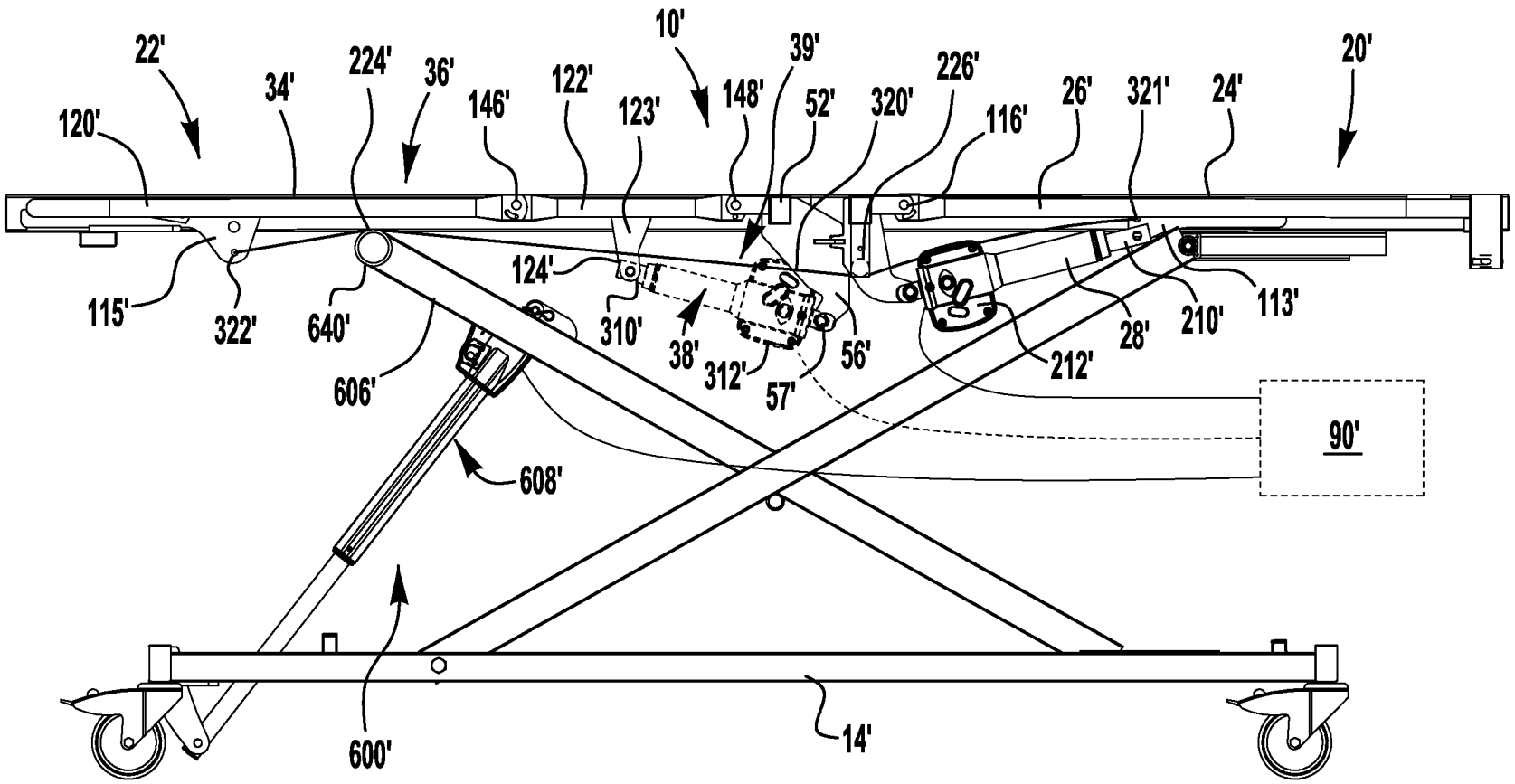
FIG. 12A is a side view of an exemplary embodiment of an adjustable bed, shown with end sections in a neutral position.
Figure 12B:
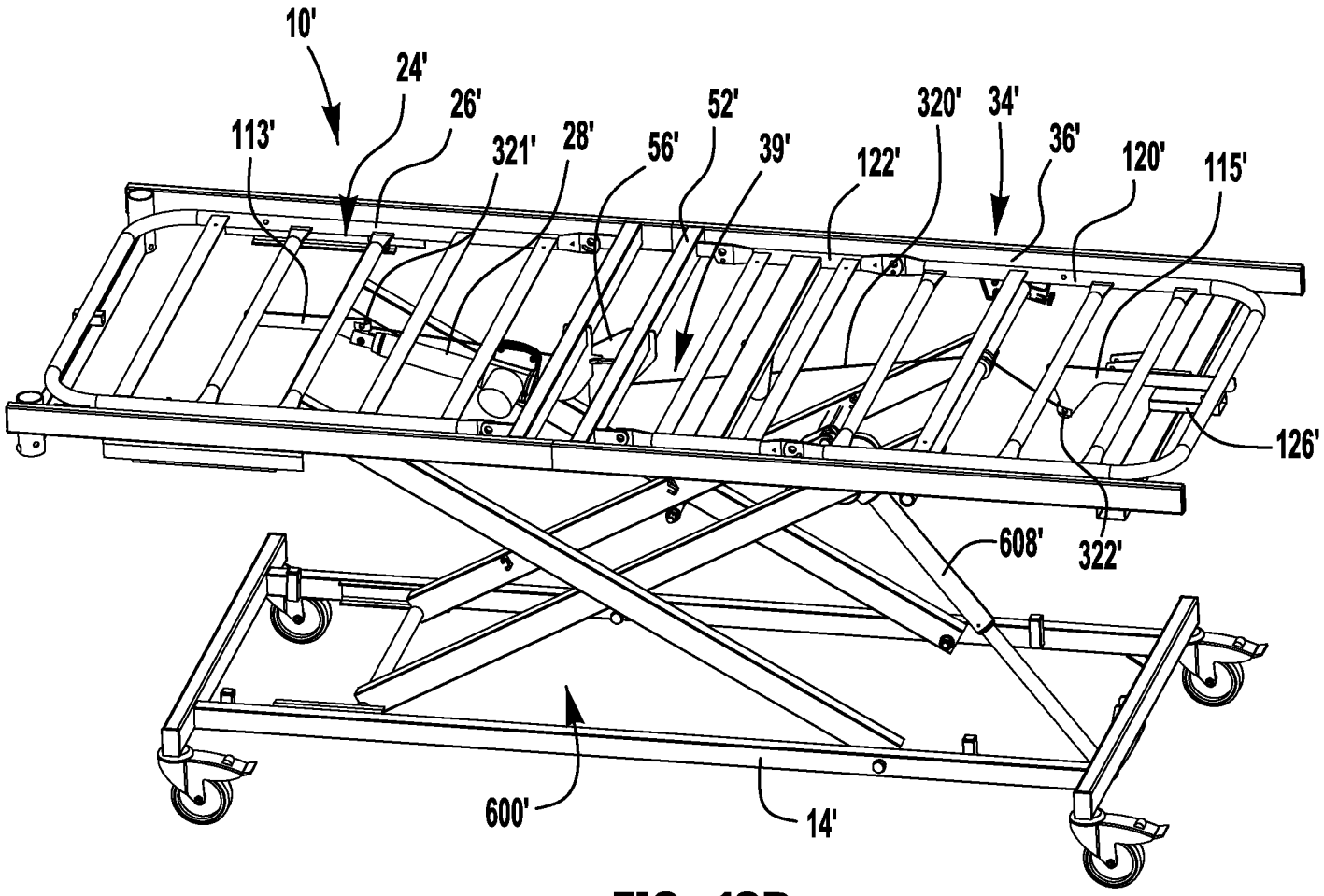
FIG. 12B is an upper perspective view of the adjustable bed of FIG. 12A, shown with end sections in the neutral position.
Figure 12C:
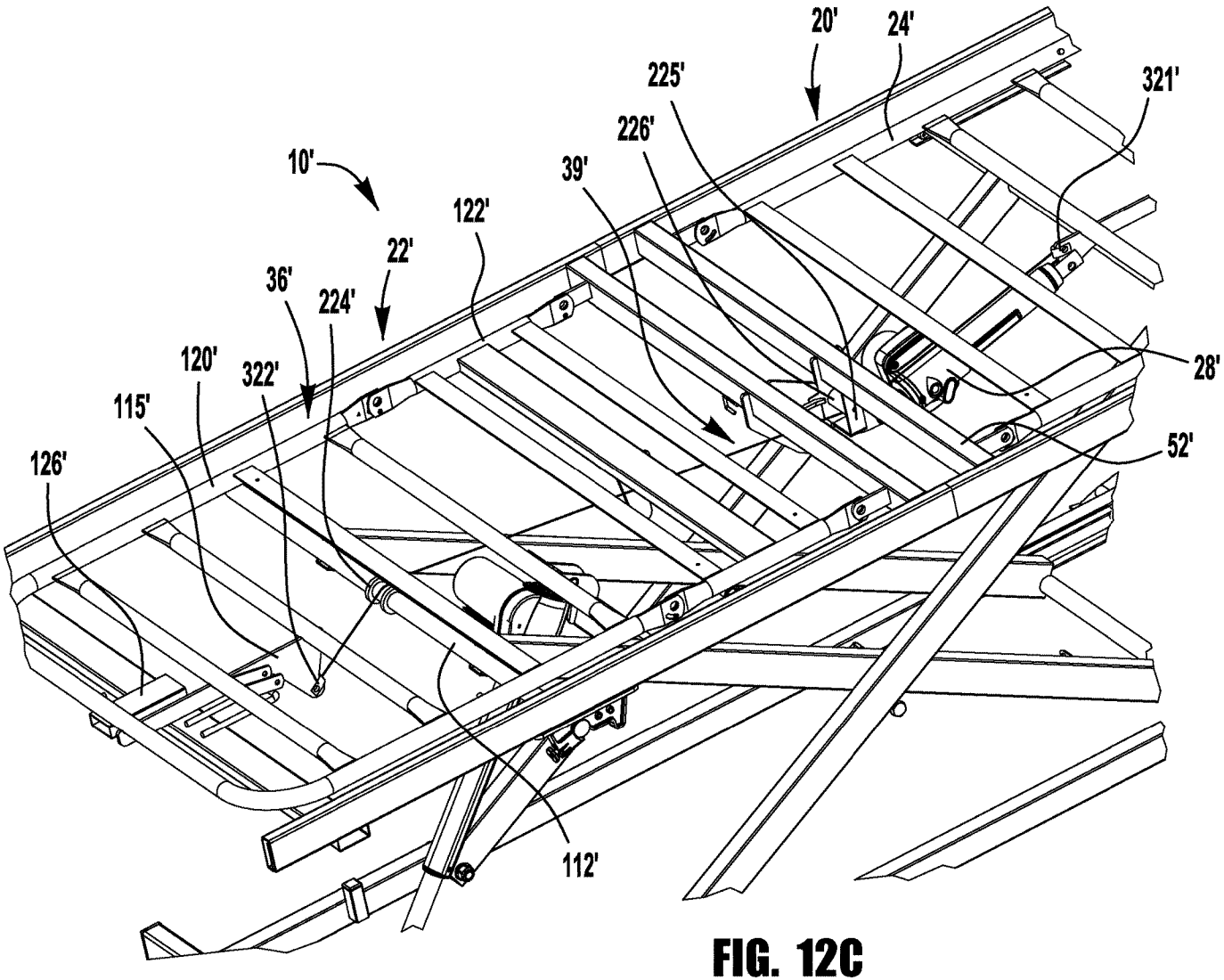
FIG. 12C is an enlarged partial upper perspective view of the adjustable bed of FIG. 12A, shown with end sections in the neutral position.
Figure 13A:
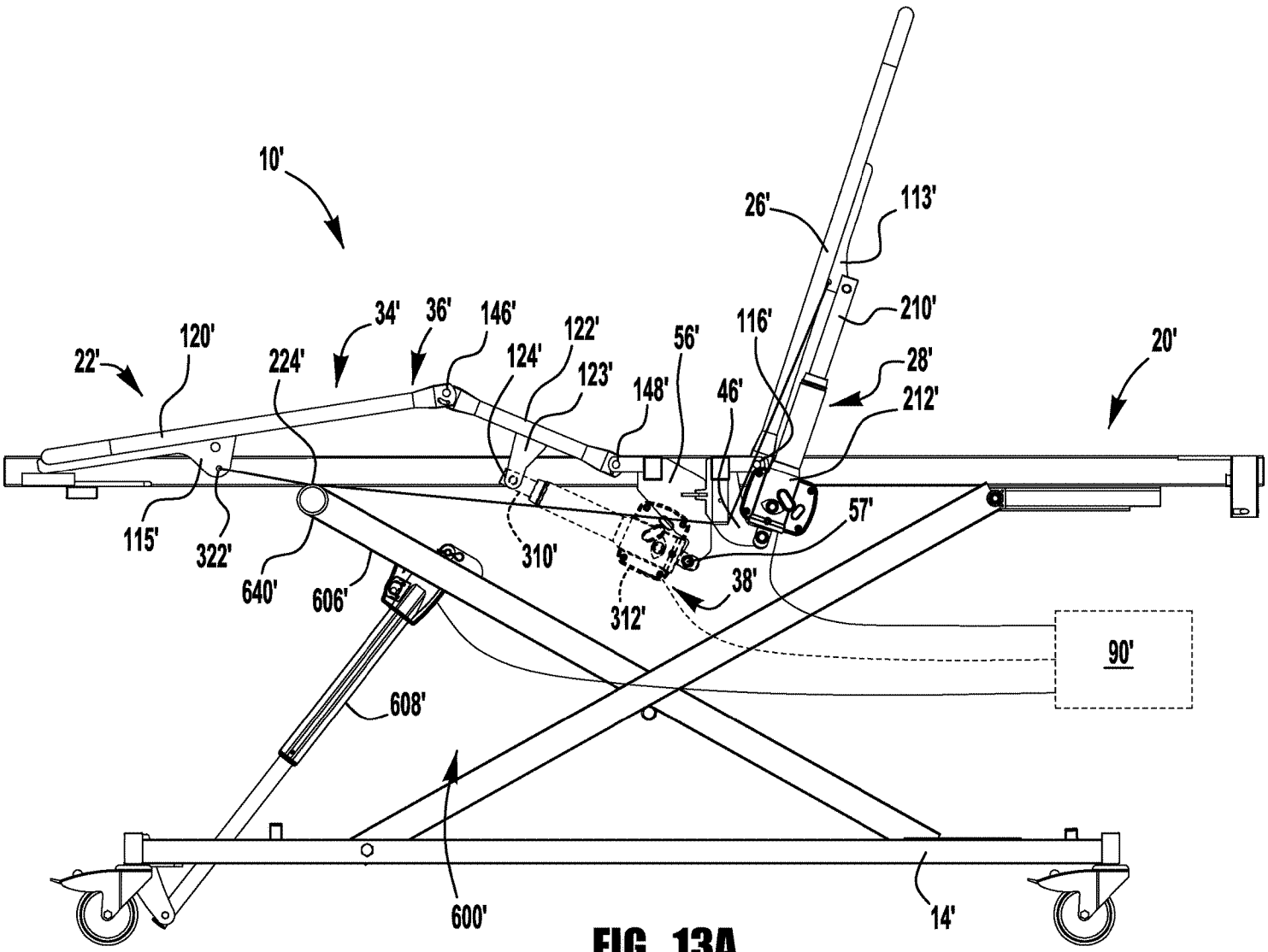
FIG. 13A is a side view of the adjustable bed of FIG. 12A, shown with end sections in an elevated position.
Figure 13B:
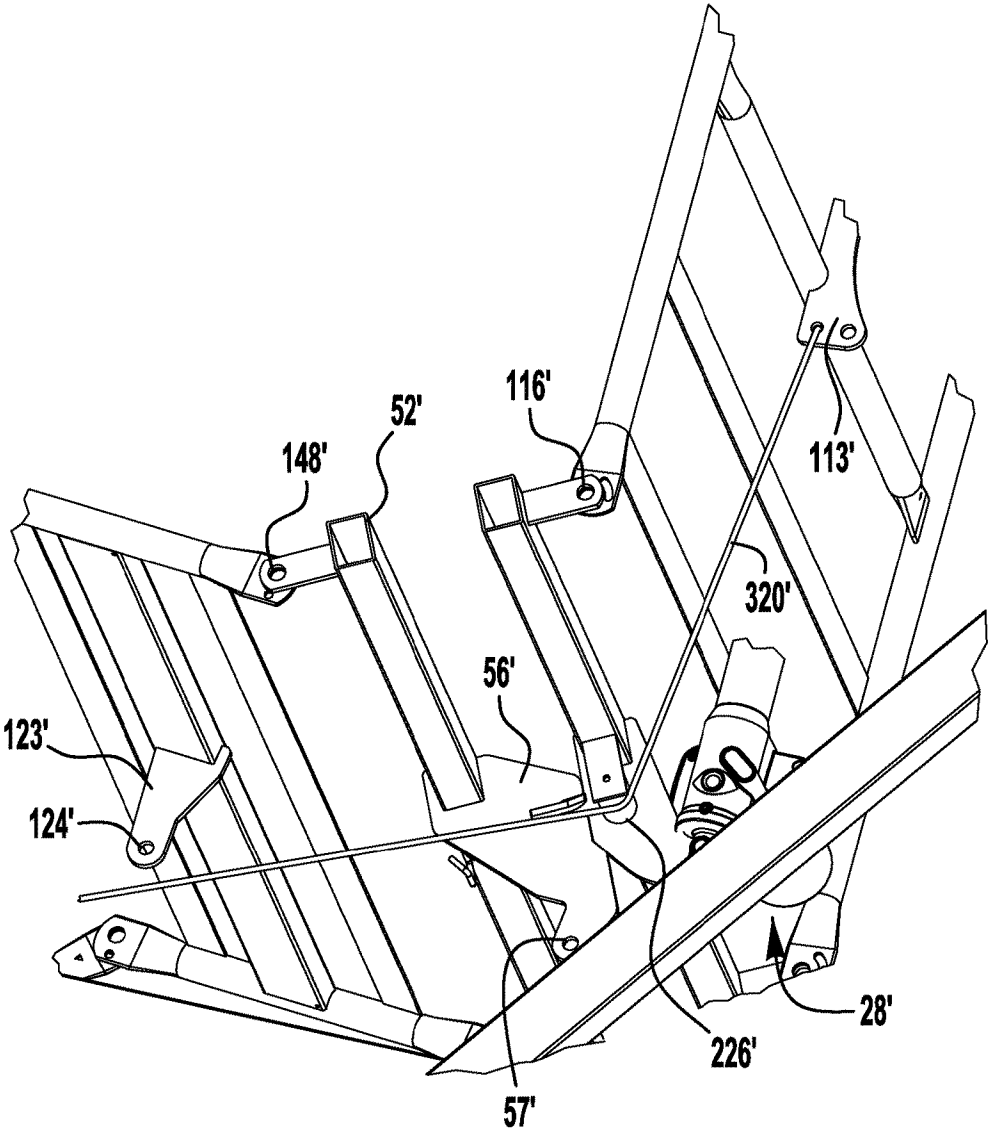
FIG. 13B is a partial lower perspective view of the adjustable bed of FIG. 12A, shown with end sections in the elevated position.
Figure 13C:
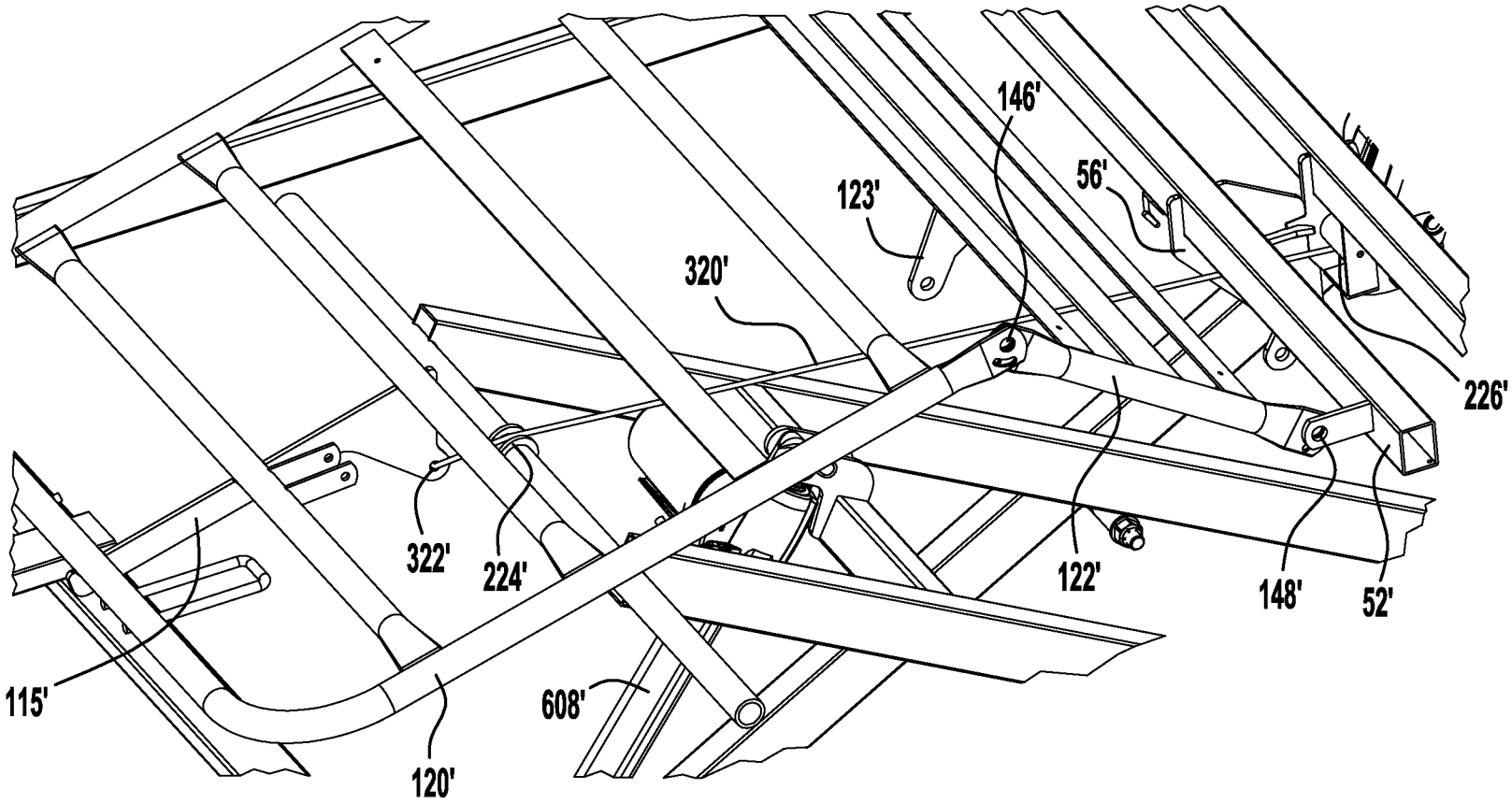
FIG. 13C is a partial upper perspective view of the adjustable bed of FIG. 12A, shown with end sections in the elevated position.

To move the exemplary adjustable bed 10' from the neutral or flat position (as shown in FIGS. 12A-12C) to the elevated or inclined position (as shown in FIGS. 13A-13C), for example, by user operation of a control button or switch, the electric motor 212' of the actuator 28' is powered to extend the shaft 210' to pivot the head end mattress support 26' about the pivot connection 116' to the elevated position. This movement of the head end mattress support 26' causes the head end actuator mounting bracket 113' to pull the first end 321' of the cable 320', such that the second end 322' of the cable 320' pulls the foot end cable mounting bracket 115' and the first section 120' of the foot end mattress support 36' to pivot the first and second sections 120', 122' of the foot end mattress support 36' about the pivot connections 146', 148'. The outer end of the first section 120' slides along a guide bar 126' (FIGS. 12B and 12C) on the foot end support frame assembly 34' to fold the foot end mattress support 36' upward about pivot connection 146' to the elevated position.

To move the exemplary adjustable bed 10' from the elevated or inclined position to the neutral or flat position, for example, by user operation of a controller (shown schematically at 90' in FIGS. 12A and 13A), the electric motor 212' is powered to retract the shaft 210' to pivot the head end mattress support 26' about the pivot connections 116' to the neutral position. This movement of the head end mattress support 26' releases tension in the cable 320', allowing the outer end of the foot end mattress support first section 120' to slide outward along the guide bar 126' (e.g., under force of the weight of the foot end mattress support 36' or bed occupant, a spring biased mechanism, or some other force) to unfold the foot end mattress support 36' downward about pivot connection 146' to the neutral position.

In another embodiment (not shown), an adjustable bed may include a powered foot end actuator and a mechanical linking head end actuator (e.g., a cable or other such arrangement), connected with a foot end mattress support and with a head end mattress support. In an exemplary embodiment, a linking actuator includes a cable and one or more pulleys or other such cable directing components utilized to direct the cable linkage such that movement of the first end section from a first position to a second position causes the cable linkage to pull the second end section from a first position to a second position.

According to another aspect of the present application, an adjustable bed having first and second adjustable end sections may be configured to facilitate modification between a first, single powered actuator configuration (e.g., the exemplary configurations of FIGS. 11A-11B and FIGS. 12A-13C), and a second, dual power actuator configuration (e.g., the exemplary configurations of FIGS. 1A-10 and FIGS. 14A-14B, as described in greater detail below). This adaptability may, for example, provide for a first, less costly configuration that utilizes only one electrically powered actuator to adjust the bed end sections, and a second, more versatile configuration that utilizes two electrically powered actuators for independent and/or synchronized adjustment of the bed end sections.

Many different types of adjustable bed assemblies may be arranged to provide for the first and second configurations described above. In one embodiment, an adjustable bed with a linking actuator connecting first and second end sections may include additional structure (e.g., brackets or other attachment points) configured to accommodate one or more additional actuator configurations, including for example, additional powered actuator mounts configured to accommodate a second powered actuator that may supplement or replace an initially installed linking actuator.

Figure 14A:
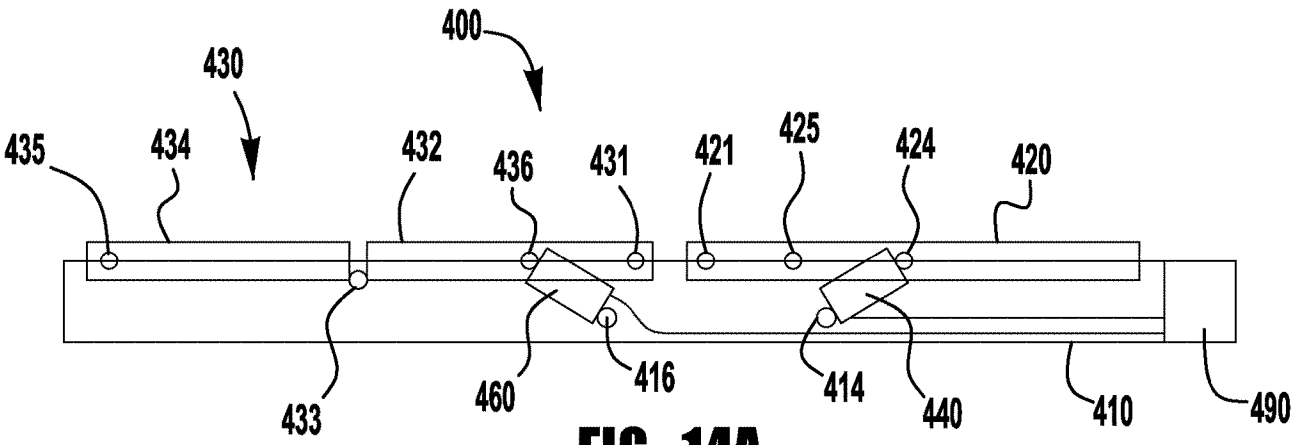
FIG. 14A is a side schematic view of an exemplary embodiment of another adjustable bed, shown with end sections in a neutral position.
Figure 14B:
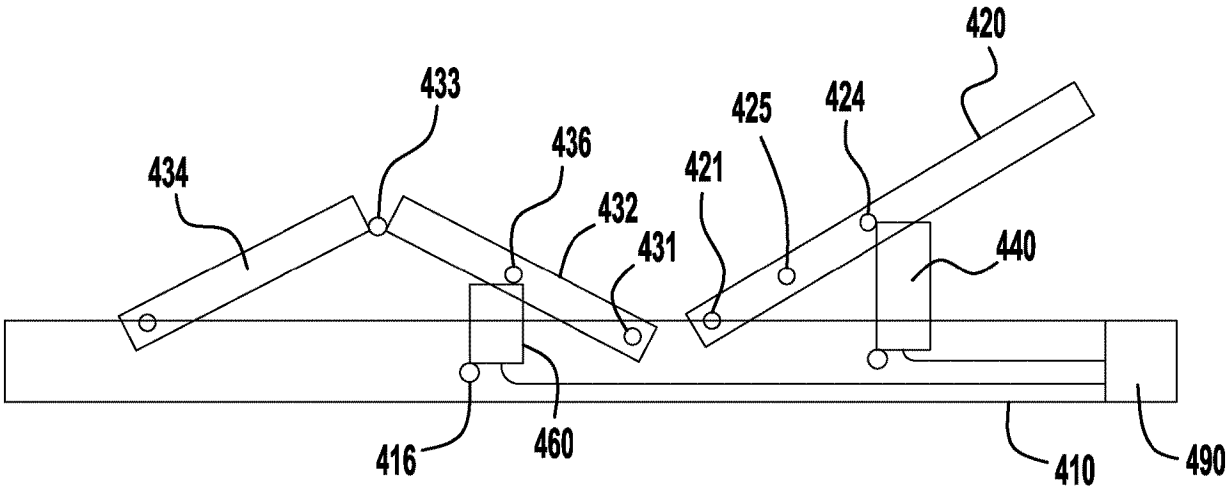
FIG. 14B is a side schematic view of the adjustable bed of FIG. 14A, shown with the end sections in an elevated position.

Referring back to FIGS. 11A and 11B, the exemplary adjustable bed 400 includes a first powered actuator mount 416 affixed to or otherwise disposed on the platform 410 and a second powered actuator mount 436 affixed to or otherwise disposed on the second end section 430 (e.g., on the outer member 434 of the second end section 430). As shown in FIGS. 14A and 14B, the adjustable bed 400 may be modified or reconfigured to a dual powered actuator configuration by removing the linking actuator 450 and coupling a second powered actuator 460 to the first and second powered actuator mounts 416, 436. The second powered actuator 460 may, but need not, be in electrical communication with the controller 490, for example, to enable independent and/or synchronous actuation of the first and second powered actuators 440, 460 through operation of the controller 490. In the reconfigured arrangement, operation of the second powered actuator 460 independent of operation of the first powered actuator 440 provides for independent movement of the second end section 430 between the neutral position (FIG. 14A) and the elevated position (FIG. 14B).

The exemplary adjustable bed 10' of FIGS. 12A-13C may also include structure (e.g., brackets or other attachment points) configured to accommodate two or more actuator configurations. In the illustrated example, similar to the adjustable beds 10 of FIGS. 1A-10, the adjustable bed 10' includes an actuator support member 56' (secured to a cross member 52' of the foot end support frame assembly 34') having a first powered foot end actuator mount 57' (e.g., a mounting hole or other interface) for attachment with a first end (e.g., the electric motor 312', as shown) of a powered foot end actuator 38' (shown in phantom in FIGS. 12A and 13A) and a foot end actuator mounting bracket 123' having a second powered foot end actuator mount 124' (e.g., a mounting hole or other interface) for attachment with a second end (e.g., the shaft 310', as shown) of the powered foot end actuator 38'. The powered foot end actuator 38' may, but need not, be electrically connected with or otherwise in communication with (e.g., via a wireless electromagnetic signal) the controller 90', which may be operable for independent and/or synchronous actuation of the two powered actuators 28', 38', as well as the actuator 608' of the lift mechanism 600'.

To reconfigure the adjustable bed 10' of FIGS. 12A-14B for head and foot section adjustment using two powered actuators, as shown in FIGS. 1-10A and described above, the cable 320' is removed from the adjustable bed by detaching the first end 321' of the cable from the head end actuator mounting bracket 113' and detaching the second end 322' of the cable 320' from the foot end cable mounting bracket 115'. The powered foot end actuator 38' is installed with the adjustable bed 10' by attaching one of the electric motor 312' (or other such driving portion) and the shaft 310' (or other such driven portion) of the powered foot end actuator 38' with the first powered foot end actuator mount 57', attaching the other of the electric motor 312' and the shaft 310' with the second powered foot end actuator mount 124', and electrically connecting the electric motor 312' with a power source (e.g., via the controller 90').

Conversely, to reconfigure an adjustable bed 10' with a dual powered actuator adjustment arrangement to utilize a single powered head end actuator 28', the powered foot end actuator 38' is disconnected from the power source and/or is detached from the first and/or second powered foot end actuator mounts 57', 124', to disable independent powered actuation of the foot end mattress support 36'. One of the cable ends 321', 322' is connected to the head actuator mounting bracket 113', the cable 320 is guided through the bed assembly (e.g., engaging first and second pulleys 224', 226'), and the other of the cable ends 321', 322' is connected to the foot end cable mounting bracket 115'. Subsequent actuation of the powered actuator 28' pivots the head end mattress support 26', which drives the foot end mattress support 36', as described above.

In another exemplary embodiment (not shown), an adjustable bed may additionally or alternatively include a head end section with both powered actuator attachment structure and mechanical linkage attachment structure, to allow modification between a dual power actuator end section adjustment arrangement and a single foot end powered actuator arrangement. In one such example, an adjustable bed includes an actuator support member having a first powered head end actuator mount (e.g., a mounting hole or other interface) for attachment with a first end (e.g., an electric motor) of a powered head end actuator and a head end actuator mounting bracket having a second powered head end actuator mount (e.g., a mounting hole or other interface) for attachment with the second end (e.g., the shaft) of the powered head end actuator. The exemplary adjustable bed further includes a first cable end mount disposed on a foot end actuator mounting bracket and a second cable end mount disposed on a head end cable mounting bracket. One or more pulleys or other such cable directing components may be utilized to direct a cable linkage such that movement of the foot end section from a neutral position to an elevated position causes the cable linkage to pull the head end section from a neutral position to an elevated position.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

We claim:

1. A bed platform for supporting a mattress, comprising:

a first platform section having:

a first support frame assembly comprising a pair of spaced apart rails, a cross member extending between the pair of spaced apart rails, and an actuator support member coupled to the cross member;

a first moveable mattress support coupled to the first support frame assembly such that the first moveable mattress support is moveable between a substantially flat position and an elevated position;

a first actuator coupled to the actuator support member of the first support frame assembly and to the first moveable mattress support, the first actuator including an extendable and retractable shaft for moving the first moveable mattress support between the substantially flat position and the elevated position;

a second platform section having:

a second support frame assembly comprising a pair of spaced apart rails and a cross member extending between the pair of spaced apart rails;

a second moveable mattress support coupled to the second support frame assembly such that the second moveable mattress support is moveable between a substantially flat position and an elevated position;

a second actuator coupled to the second moveable mattress support for moving the second moveable mattress support between the substantially flat position and the elevated position;

wherein the spaced apart rails of the first support frame assembly are connected to the spaced apart rails of the second support frame assembly when the first platform section is assembled with the second platform section; and wherein the actuator support member of the first support frame assembly is coupled to the cross member of the second support frame assembly by a coupling arrangement when the first platform section is assembled with the second platform section; and wherein operation of the extendable and retractable shaft of the first actuator applies force to the actuator support member of the first support frame assembly and wherein a portion of said force is transferred through the coupling arrangement to the cross member of the second support frame assembly.

2. The bed platform frame of claim 1 wherein the first actuator applies force to the actuator support member of the first support frame assembly and wherein a portion of said force is transferred to the cross member of the second support frame assembly.

3. The bed platform frame of claim 1 wherein the spaced apart rails of the first support frame assembly telescopically engage the spaced apart rails of the second support frame assembly when the first platform section is assembled with the second platform section.

4. The bed platform frame of claim 1 wherein at least one of the rails of the first support frame assembly extends into at least one of the rails of the second support frame assembly when the first platform section is assembled with the second platform section.

5. The bed platform frame of claim 1 wherein the second support frame assembly further includes an actuator support member coupled to the cross member, with the second actuator being coupled to the actuator support member of the second support frame assembly, and further wherein the actuator support member of the second support frame assembly is coupled to the cross member of the first support frame assembly when the first platform section is assembled with the second platform section.

6. The bed platform frame of claim 5 wherein the actuator support member of the first support frame assembly is coupled to the actuator support member of the second support frame assembly to couple the actuator support member of the first support frame assembly to the cross member of the second support frame assembly and to couple the actuator support member of the second support frame assembly to the cross member of the first support frame assembly when the first platform section is assembled with the second platform section.

7. The bed platform frame of claim 5 wherein the actuator support member of the first support frame assembly telescopically engages the actuator support member of the second support frame assembly when the first platform section is assembled with the second platform section.

8. The bed platform frame of claim 5 wherein the actuator support member of the first support frame assembly is aligned with the actuator support member of the second support frame assembly when the first platform section is assembled with the second platform section.

9. The bed platform frame of claim 5 wherein the actuator support member of the first support frame assembly extends into the actuator support member of the second support frame assembly when the first platform section is assembled with the second platform section.

10. The bed platform frame of claim 5 wherein the actuator support member of the first support frame assembly is fixed to the cross member of the first support frame assembly and the actuator support member of the second support frame assembly is fixed to the cross member of the second support frame assembly.

11. The bed platform of claim 1, wherein the actuator support member of the first support frame assembly comprises a first bracket and the actuator support member of the second support frame assembly comprises a second bracket, wherein the coupling arrangement comprises a direct attachment between the first bracket and the second bracket.

12. A bed, comprising:

a first platform section having:

a first support frame assembly comprising a pair of spaced apart rails, a cross member extending between the pair of spaced apart rails, and an actuator support member coupled to the cross member;

a first moveable mattress support coupled to the first support frame assembly such that the first moveable mattress support is moveable between a substantially flat position and an elevated position;

a first actuator coupled to the actuator support member of the first support frame assembly and to the first moveable mattress support, the first actuator including an extendable and retractable shaft for moving the first moveable mattress support between the substantially flat position and the elevated position;

a second platform section having:

a second support frame assembly comprising a pair of spaced apart rails and a cross member extending between the pair of spaced apart rails;

a second moveable mattress support coupled to the second support frame assembly such that the second moveable mattress support is moveable between a substantially flat position and an elevated position;

a second actuator coupled to the second moveable mattress support for moving the second moveable mattress support between the substantially flat position and the elevated position;

a lift mechanism supporting the first and second platform sections, wherein the lift mechanism is configured to raise and lower the first and second platform sections;

wherein the spaced apart rails of the first support frame assembly are connected to the spaced apart rails of the second support frame assembly when the first platform section is assembled with the second platform section;

wherein the actuator support member of the first support frame assembly is coupled to the cross member of the second support frame assembly by a coupling arrangement when the first platform section is assembled with the second platform section; and wherein operation of the extendable and retractable shaft of the first actuator applies force to the actuator support member of the first support frame assembly and wherein a portion of said force is transferred through the coupling arrangement to the cross member of the second support frame assembly.

13. The bed of claim 12 wherein the first actuator applies force to the actuator support member of the first support frame assembly and wherein a portion of said force is transferred to the cross member of the second support frame assembly.

14. The bed of claim 12 wherein the spaced apart rails of the first support frame assembly telescopically engage the spaced apart rails of the second support frame assembly when the first platform section is assembled with the second platform section.

15. The bed of claim 12 wherein at least one of the rails of the first support frame assembly extends into at least one of the rails of the second support frame assembly when the first platform section is assembled with the second platform section.

16. The bed of claim 12 wherein the second support frame assembly further includes an actuator support member coupled to the cross member, with the second actuator being coupled to the actuator support member of the second support frame assembly, and further wherein the actuator support member of the second support frame assembly is coupled to the cross member of the first support frame assembly when the first platform section is assembled with the second platform section.

17. The bed of claim 16 wherein the actuator support member of the first support frame assembly is coupled to the actuator support member of the second support frame assembly to couple the actuator support member of the first support frame assembly to the cross member of the second support frame assembly and to couple the actuator support member of the second support frame assembly to the cross member of the first support frame assembly when the first platform section is assembled with the second platform section.

18. The bed of claim 16 wherein the actuator support member of the first support frame assembly telescopically engages the actuator support member of the second support frame assembly when the first platform section is assembled with the second platform section.

19. The bed of claim 16 wherein the actuator support member of the first support frame assembly is aligned with the actuator support member of the second support frame assembly when the first platform section is assembled with the second platform section.

20. The bed of claim 16 wherein the actuator support member of the first support frame assembly extends into the actuator support member of the second support frame assembly when the first platform section is assembled with the second platform section.

21. The bed of claim 16 wherein the actuator support member of the first support frame assembly is fixed to the cross member of the first support frame assembly and the actuator support member of the second support frame assembly is fixed to the cross member of the second support frame assembly.

22. The bed of claim 16, wherein the actuator support member of the first support frame assembly comprises a first bracket and the actuator support member of the second support frame assembly comprises a second bracket, wherein the coupling arrangement comprises a direct attachment between the first bracket and the second bracket.

* * * * *